US012623766B2

(12) United States Patent
Endrizzi et al.

(10) Patent No.: US 12,623,766 B2
(45) Date of Patent: May 12, 2026

(54) THRUSTER CONTROL FOR A BOAT

(71) Applicant: Polaris Industries Inc., Medina, MN (US)

(72) Inventors: James J. Endrizzi, Plymouth, MN (US); Jacob L. Stock, Dellwood, MN (US); Austin R. Bartz, Forest Lake, MN (US); Michael J. Fuchs, Blaine, MN (US); Erik W. Rogers, Cadillac, MI (US); Michael T. Yobe, Knoxville, TN (US); Joseph P. Nuxoll, San Jose, CA (US); Kevin P. Blair, Forest Lake, MN (US); John E. Kraus, Forest Lake, MN (US)

(73) Assignee: POLARIS INDUSTRIES INC., Medina, MN (US)

( * ) Notice: Subject to any disclaimer, the term of this patent is extended or adjusted under 35 U.S.C. 154(b) by 758 days.

(21) Appl. No.: 17/883,066

(22) Filed: Aug. 8, 2022

(65) Prior Publication Data

US 2023/0049367 A1 Feb. 16, 2023

Related U.S. Application Data

(60) Provisional application No. 63/231,452, filed on Aug. 10, 2021.

(51) Int. Cl.
*B63H 21/21* (2006.01)
*B63B 1/12* (2006.01)
(Continued)

(52) U.S. Cl.
CPC ..... *B63H 21/21* (2013.01); *B63B 1/125* (2013.01); *B63B 35/38* (2013.01); *B63B 79/15* (2020.01);
(Continued)

(58) Field of Classification Search
CPC ..... B63H 20/00; B63H 20/12; B63H 21/00; B63H 21/21; B63H 25/00; B63H 25/42;
(Continued)

(56) References Cited

U.S. PATENT DOCUMENTS 4,056,073 A 11/1977 Dashew et al.
5,172,324 A 12/1992 Knight
(Continued)

FOREIGN PATENT DOCUMENTS

CA 2396479 A1 10/2003
CN 203946267 U 11/2014
(Continued)

OTHER PUBLICATIONS

European Search Report for EP Patent Application No. 20870163.1, Issued on Nov. 29, 2023, 9 pages.
(Continued)

*Primary Examiner* — Lars A Olson
(74) *Attorney, Agent, or Firm* — SCHWEGMAN LUNDBERG & WOESSNER, P.A.

(57) ABSTRACT

Techniques for thruster system control for a pontoon boat or other watercraft. A thruster system may comprise a plurality of thrusters used to control movement of the pontoon boat in addition to an outboard prime mover. The thrusters may be fixed and/or steerable thrusters. In examples, the thrusters may be retracted based on identifying a condition in which the thrusters may be damaged. The thrusters may be deployed based on identifying a condition in which the thrusters may be used to recharge an associated energy source. User input to control the thrusters may be adapted to account for external forces acting on the pontoon boat. A user interface is provided with which to control the thruster system, via which an operator manipulates a movement intent line to control the thruster system. The user interface
(Continued)

may further comprise obstacle indicators, thereby enabling the operator to maneuver the pontoon boat accordingly.

17 Claims, 15 Drawing Sheets

(51) Int. Cl.
*B63B 35/38* (2006.01)
*B63B 79/15* (2020.01)
*B63B 79/40* (2020.01)
*B63H 20/12* (2006.01)
*B63H 25/42* (2006.01)

(52) U.S. Cl.
CPC ..... *B63B 79/40* (2020.01); *B63H 20/12* (2013.01); *B63H 25/42* (2013.01); *B63H 2021/216* (2013.01)

(58) Field of Classification Search
CPC ..... B63H 25/02; B63B 79/00; B63B 79/15; B63B 79/40; B63B 1/00; B63B 1/125; B63B 35/00; B63B 35/38
USPC ..... 440/1
See application file for complete search history.

(56) References Cited

U.S. PATENT DOCUMENTS 5,259,331 A 11/1993 Hagan
5,502,587 A 3/1996 Frigo
6,142,841 A 11/2000 Alexander et al.
6,249,241 B1 6/2001 Jordan et al.
6,325,683 B1 12/2001 Yocom
6,434,512 B1 8/2002 Discenzo
6,439,941 B2 8/2002 Mcclure et al.
6,469,664 B1 10/2002 Michaelson et al.
6,581,537 B2 6/2003 Mcbride et al.
6,734,808 B1 5/2004 Michaelson et al.
7,182,033 B1 2/2007 Phillips et al.
7,185,599 B1 3/2007 Griffiths et al.
7,315,779 B1 1/2008 Rioux et al.
7,380,538 B1 6/2008 Gagnon et al.
7,416,458 B2 8/2008 Suemori et al.
7,530,345 B1 5/2009 Plante et al.
7,836,787 B2 11/2010 Oguma
7,841,915 B2 11/2010 Bourret et al.
7,900,510 B1 3/2011 O'Brien
7,950,340 B1 5/2011 Curtis
8,066,538 B1 11/2011 Kostrzewski
8,146,524 B1 4/2012 Cote et al.
8,177,594 B2 5/2012 Dagenais et al.
8,202,136 B2 6/2012 Dagenais et al.
8,441,956 B2 5/2013 Misumi et al.
8,589,004 B1 11/2013 Kanno
8,622,778 B2 1/2014 Tyers et al.
8,645,012 B2 2/2014 Salmon et al.
8,725,312 B2 5/2014 Mori et al.
8,753,154 B2 6/2014 Fujino et al.
8,818,587 B1 8/2014 Arbuckle et al.
8,924,054 B1 12/2014 Arbuckle et al.
8,965,606 B2 2/2015 Mizutani
9,108,710 B1 8/2015 Mcchesney et al.
9,248,895 B1 2/2016 Gendron et al.
9,376,189 B1 6/2016 De et al.
9,517,825 B1 12/2016 Anschuetz et al.
9,517,826 B1 12/2016 Leblond
9,682,757 B1 6/2017 Bourret
9,738,364 B2 8/2017 Abney
9,778,657 B2 10/2017 Tyers
10,048,690 B1 8/2018 Hilbert et al.
10,065,721 B1 9/2018 Girard et al.
10,272,977 B2 4/2019 Hashizume et al.
10,281,917 B2 5/2019 Tyers
10,377,458 B1 8/2019 Mcginley
10,556,642 B1 2/2020 Massicotte et al.
10,723,429 B1 7/2020 Wiatrowski et al.
10,829,190 B1 11/2020 Pugh et al.
10,871,775 B2 12/2020 Hashizume et al.
11,046,406 B1 6/2021 Kunanec et al.
11,208,188 B2 12/2021 Fishburn et al.
11,348,191 B2 5/2022 Tian et al.
11,390,262 B2 7/2022 Brandt et al.
11,427,284 B1 8/2022 Lieb
11,618,537 B2 * 4/2023 Schmid ..... B63B 79/40 440/38
11,643,176 B1 * 5/2023 Mueller ..... B63H 25/42 440/1
11,738,841 B2 8/2023 Fishburn et al.
11,827,319 B1 * 11/2023 Perdomo Tornbaum ..... B63H 25/42
2002/0129410 P1 9/2002 Amorao et al.
2003/0137445 A1 7/2003 Van Rees et al.
2004/0222902 A1 11/2004 Wortsmith
2005/0181687 A1 8/2005 Okumura et al.
2005/0272322 A1 12/2005 Mizuguchi et al.
2006/0228959 A1 10/2006 Ruiz
2007/0227429 A1 10/2007 Okuyama et al.
2007/0249244 A1 10/2007 Watanabe et al.
2007/0276563 A1 11/2007 Kaji
2008/0038967 A1 2/2008 Shinde et al.
2008/0081521 A1 4/2008 Mizokawa
2008/0119094 A1 5/2008 Mizutani et al.
2008/0254689 A1 10/2008 Kaji
2009/0101056 A1 4/2009 Waldo
2009/0107377 A1 4/2009 Duquette et al.
2009/0107379 A1 4/2009 Duquette et al.
2009/0107380 A1 4/2009 Duquette et al.
2009/0139437 A1 6/2009 Simard et al.
2009/0176418 A1 7/2009 Mizutani
2009/0224132 A1 9/2009 Mochizuki
2009/0227157 A1 9/2009 Mochizuki
2009/0264029 A1 10/2009 Dagenais et al.
2010/0041286 A1 2/2010 Bourret et al.
2010/0114412 A1 5/2010 Mizutani
2010/0178815 A1 7/2010 Leblanc
2010/0240266 A1 9/2010 Shibayama et al.
2010/0256845 A1 10/2010 Mizutani et al.
2010/0267296 A1 10/2010 Kuriyagawa et al.
2011/0217886 A1 9/2011 Kuriyagawa et al.
2011/0217888 A1 9/2011 Kuriyagawa et al.
2011/0223815 A1 9/2011 Kinoshita
2011/0294370 A1 12/2011 Kuriyagawa et al.
2012/0021659 A1 1/2012 Ota
2012/0025965 A1 2/2012 Mochizuki et al.
2012/0129410 A1 5/2012 Tyers
2013/0316603 A1 11/2013 Hagi
2014/0158037 A1 6/2014 George
2014/0220837 A1 8/2014 Kuriyagawa et al.
2014/0295717 A1 10/2014 Kuriyagawa et al.
2014/0349530 A1 11/2014 Mochizuki et al.
2014/0364019 A1 12/2014 Ito et al.
2015/0086373 A1 3/2015 Kaneko et al.
2015/0089427 A1 3/2015 Akuzawa
2016/0003636 A1 1/2016 Ng-Thow-Hing et al.
2016/0011000 A1 1/2016 Vanderburgh
2016/0059855 A1 3/2016 Rebhan et al.
2016/0176409 A1 6/2016 Kirsch et al.
2016/0187883 A1 6/2016 Tyers et al.
2016/0318445 A1 11/2016 Sugimoto
2016/0375974 A1 12/2016 Loftus et al.
2017/0137103 A1 5/2017 Ito
2017/0152012 A1 6/2017 Vachon
2017/0205829 A1 7/2017 Tyers
2017/0268896 A1 9/2017 Bai et al.
2017/0277192 A1 9/2017 Gupta et al.
2017/0369055 A1 12/2017 Saigusa et al.
2018/0004209 A1 1/2018 Akuzawa et al.
2018/0017974 A1 1/2018 Tyers
2018/0037227 A1 2/2018 Dsa et al.
2018/0134354 A1 5/2018 Suzuki et al.
2018/0151009 A1 5/2018 Kim et al.
2018/0283874 A1 10/2018 Hashizume et al.
2018/0286251 A1 10/2018 Fujima et al.

(56) References Cited

U.S. PATENT DOCUMENTS

| | | | |
|---|---|---|---|
| 2018/0288821 | A1 | 10/2018 | Kanayama et al. |
| 2018/0345994 | A1 | 12/2018 | Goerick |
| 2019/0019352 | A1 | 1/2019 | Harper |
| 2019/0048639 | A1 | 2/2019 | Lickfelt et al. |
| 2019/0071160 | A1 | 3/2019 | Bylsma et al. |
| 2019/0233074 | A1 | 8/2019 | Wiatrowski et al. |
| 2019/0361446 | A1 | 11/2019 | Ward et al. |
| 2020/0001953 | A1 | 1/2020 | Vachon et al. |
| 2020/0026293 | A1 | 1/2020 | Hashizume et al. |
| 2020/0042013 | A1 | 2/2020 | Kelkar et al. |
| 2020/0064466 | A1 | 2/2020 | Harper et al. |
| 2020/0086879 | A1 | 3/2020 | Lakshmi et al. |
| 2020/0089969 | A1 | 3/2020 | Lakshmi et al. |
| 2020/0108902 | A1 | 4/2020 | Wong et al. |
| 2020/0156751 | A1 | 5/2020 | Skrzypchak et al. |
| 2020/0252775 | A1 | 8/2020 | Morschhauser et al. |
| 2020/0301437 | A1 | 9/2020 | Misu et al. |
| 2020/0312155 | A1 | 10/2020 | Kelkar et al. |
| 2020/0385097 | A1 | 12/2020 | Donat et al. |
| 2021/0061431 | A1 | 3/2021 | Mcginley et al. |
| 2021/0065224 | A1 | 3/2021 | Kawashima |
| 2021/0086875 | A1 | 3/2021 | Nakatani |
| 2021/0094661 | A1 | 4/2021 | Schmid et al. |
| 2021/0094665 | A1 | 4/2021 | Fuchs et al. |
| 2021/0129954 | A1 | 5/2021 | Inoue |
| 2021/0141396 | A1 | 5/2021 | Kinoshita |
| 2021/0155333 | A1 | 5/2021 | Mizutani |
| 2021/0188406 | A1 | 6/2021 | Nakatani |
| 2021/0229791 | A1 | 7/2021 | Inoue |
| 2021/0250737 | A1 | 8/2021 | Herga et al. |
| 2021/0263513 | A1 | 8/2021 | Liu et al. |
| 2021/0293545 | A1 | 9/2021 | Zhang et al. |
| 2021/0335060 | A1 | 10/2021 | Bauer et al. |
| 2021/0380210 | A1 | 12/2021 | Fishburn et al. |
| 2022/0001962 | A1 | 1/2022 | Krosschell et al. |
| 2022/0048513 | A1 | 2/2022 | Xu et al. |
| 2022/0169339 | A1 | 6/2022 | Jaziri et al. |
| 2022/0177087 | A1 | 6/2022 | Amma et al. |
| 2022/0177088 | A1 | 6/2022 | Amma |
| 2022/0234701 | A1 | 7/2022 | Suda |
| 2022/0306256 | A1 | 9/2022 | Ohiso |
| 2022/0306257 | A1 | 9/2022 | Afman et al. |
| 2022/0308576 | A1 | 9/2022 | Judson et al. |
| 2022/0317857 | A1 | 10/2022 | Tarchala et al. |
| 2022/0332303 | A1 | 10/2022 | Bernatchez et al. |
| 2022/0371700 | A1 | 11/2022 | Hall et al. |
| 2022/0371715 | A1 | 11/2022 | Ito |
| 2022/0383646 | A1 | 12/2022 | Hosoya et al. |
| 2023/0008091 | A1 | 1/2023 | Tsubone et al. |
| 2023/0012090 | A1 | 1/2023 | Tsubone et al. |
| 2023/0168678 | A1 | 6/2023 | Kameyama et al. |
| 2023/0373606 | A1 | 11/2023 | Fishburn et al. |

FOREIGN PATENT DOCUMENTS

| | | | |
|---|---|---|---|
| CN | 104276265 | A | 1/2015 |
| CN | 109285389 | A | 1/2019 |
| CN | 115703533 | A | 2/2023 |
| ES | 2046117 | A2 | 1/1994 |
| JP | 59-073387 | A | 4/1984 |
| JP | 61-282193 | A | 12/1986 |
| JP | 05-065098 | A | 3/1993 |
| JP | 06-227478 | A | 8/1994 |
| JP | 07-047992 | A | 2/1995 |
| JP | 08-029745 | A | 2/1996 |
| JP | 08-032523 | A | 2/1996 |
| JP | 08-032524 | A | 2/1996 |
| JP | 08-032525 | A | 2/1996 |
| JP | 08-032528 | A | 2/1996 |
| JP | 08-284705 | A | 10/1996 |
| JP | 08-284725 | A | 10/1996 |
| JP | 08-284726 | A | 10/1996 |
| JP | 09-053500 | A | 2/1997 |
| JP | 09-301279 | A | 11/1997 |
| JP | 10-218084 | A | 8/1998 |
| JP | 2836738 | B2 | 12/1998 |
| JP | 2898502 | B2 | 6/1999 |
| JP | 2000-038195 | A | 2/2000 |
| JP | 2001-287693 | A | 10/2001 |
| JP | 3305522 | B2 | 7/2002 |
| JP | 3410867 | B2 | 5/2003 |
| JP | 3523711 | B2 | 4/2004 |
| JP | 2004-178574 | A | 6/2004 |
| JP | 3672133 | B2 | 7/2005 |
| JP | 2006-036008 | A | 2/2006 |
| JP | 3744961 | B2 | 2/2006 |
| JP | 3745406 | B2 | 2/2006 |
| JP | 2006-160214 | A | 6/2006 |
| JP | 2006-219002 | A | 8/2006 |
| JP | 3939777 | B2 | 7/2007 |
| JP | 4791340 | B2 | 10/2011 |
| JP | 2012-096774 | A | 5/2012 |
| JP | 2015-068831 | A | 4/2015 |
| JP | 2015-069656 | A | 4/2015 |
| KR | 10-2016-0006943 | A | 1/2016 |
| WO | 2005/030574 | A1 | 4/2005 |
| WO | 2016/166620 | A1 | 10/2016 |
| WO | 2018/232376 | A1 | 12/2018 |
| WO | 2019/081019 | A1 | 5/2019 |
| WO | 2021/075319 | A1 | 4/2021 |

OTHER PUBLICATIONS

Evinrude unveils $5,999 iDock joystick piloting system, Boating Industry, dated Jul. 10, 2017; 4 pages.

Faria Marine Instruments Owner's Manual; 4 pages.

Hummingbird.com, 2019 Hummingbird Products brochure; 40 pages.

International Preliminary Report on Patentability received for PCT Patent Application No. PCT/US2020/052973, mailed on Apr. 7, 2022, 8 pages.

International Search Report and Written Opinion issued by the International Searching Authority, dated Dec. 21, 2020, for International Patent Application No. PCT/US2020/052973; 17 pages.

International Search Report and Written Opinion, issued by the International Searching Authority, dated Dec. 21, 2020, for International Patent Application No. 3; 9 pages.

Office Action issued by the Canadian Intellectual Property Office, dated Aug. 10, 2021, for Canadian Patent Application No. 3,082,689; 6 pages.

"Chinese Application Serial No. 202210947519.5, Office Action mailed Feb. 14, 2025", w/ English Translation, 23 pgs.

"Chinese Application Serial No. 202210947519.5, Response filed Aug. 18, 2025 to Office Action mailed Feb. 14, 2025", W/ English Claims, 31 pgs.

"Chinese Application Serial No. 202210947519.5, Office Action mailed Nov. 15, 2025", w English Translation, 20 pgs.

* cited by examiner

THRUSTER CONTROL FOR A BOAT

RELATED APPLICATIONS

The present disclosure claims priority to U.S. Provisional Patent Application No. 63/231,452, filed Aug. 10, 2021, titled THRUSTER CONTROL FOR A BOAT, the entire disclosure of which is expressly incorporated by reference herein.

BACKGROUND OF THE DISCLOSURE

Pontoons and other types of multi-hull boats may have one or more outboard motors for propelling and steering the boat. However, maneuvering such boats using an outboard motor may be difficult, especially in confined or challenging environments, such as when docking or navigating around obstacles.

It is with respect to these and other general considerations that embodiments have been described. Also, although relatively specific problems have been discussed, it should be understood that the embodiments should not be limited to solving the specific problems identified in the background.

SUMMARY OF THE DISCLOSURE

As set forth above, embodiments provided herein relate to recreational vehicles. Exemplary embodiments include but are not limited to the following examples.

In one aspect, a pontoon boat is provided. The pontoon boat comprises: a plurality of pontoons; a deck supported by the plurality of pontoons, the deck having an outer perimeter; a propulsion system having at least one prime mover that propels the pontoon boat through the water; a thruster system including a first thruster and a second thruster, wherein at least one thruster of the first thruster or the second thruster has a deactivated position and an in-use position; and a controller communicatively coupled to the first thruster and the second thruster, the controller configured to: identify a first condition; based on the first condition, configure the at least one thruster to be in the in-use position; identify a second condition; and based on the second condition, configure the at least one thruster to be in the deactivated position.

In another aspect, a thruster system for a pontoon boat is provided. The thruster system comprises: a first thruster; a second thruster; a plurality of sensors; and a controller configured to: obtain, via a network bus of the pontoon boat, propulsion system information associated with a propulsion system of the pontoon boat; identify, based on the propulsion system information, a condition; and based on the identified condition, configure at least one thruster of the first thruster and the second thruster to be in either an in-use position or a deactivated position.

In a further aspect, a method for generating a user interface associated with a thruster system is provided. The method comprises: presenting an outline associated with a pontoon boat; receiving a user input indicating a target movement for the pontoon boat; generating, based on the received user input, a movement intent line in association with the outline, wherein the movement intent line indicates at least one of a target movement direction, a target movement magnitude, or a target movement rotation; and updating the user interface to comprise the generated movement intent line.

While multiple embodiments are disclosed, still other embodiments of the presently disclosed subject matter will become apparent to those skilled in the art from the following detailed description, which shows and describes illustrative embodiments of the disclosed subject matter. Accordingly, the drawings and detailed description are to be regarded as illustrative in nature and not restrictive.

BRIEF DESCRIPTION OF THE DRAWINGS

The above-mentioned and other features and advantages of this disclosure, and the manner of attaining them, will become more apparent and will be better understood by reference to the following description of embodiments of the invention taken in conjunction with the accompanying drawings, wherein.

Figure 1A:
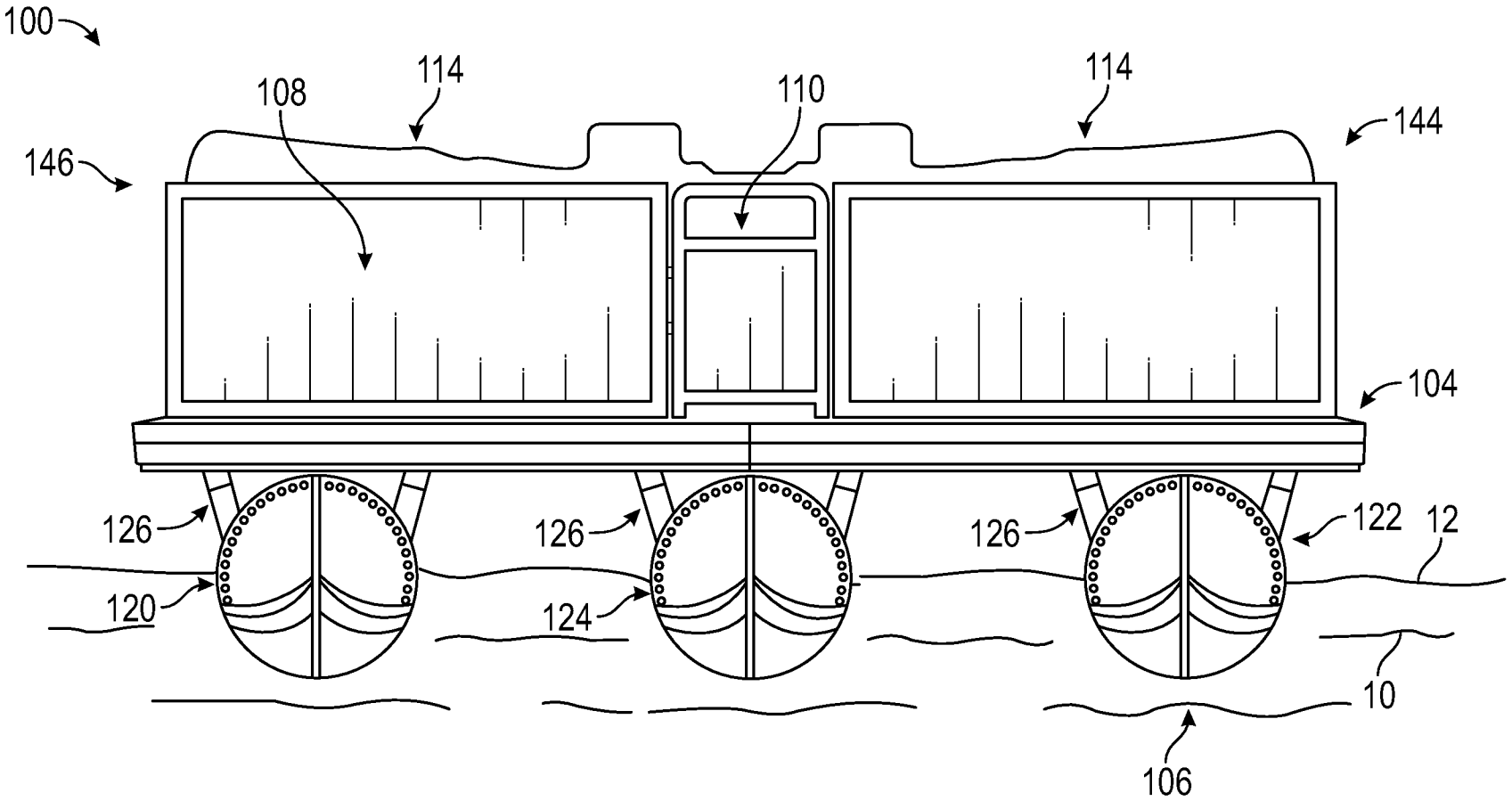
FIG. 1A illustrates a front view of a pontoon boat having a deck supported by three pontoons.

Corresponding reference characters indicate corresponding parts throughout the several views. Although the drawings represent embodiments of the present disclosure, the drawings are not necessarily to scale, and certain features may be exaggerated in order to better illustrate and explain the present disclosure. The examples set out herein illustrate embodiments of the disclosure and such examples are not to be construed as limiting the scope of the disclosure in any manner.

DETAILED DESCRIPTION OF THE DRAWINGS

For the purposes of promoting an understanding of the principles of the present disclosure, reference is now made to the embodiments illustrated in the drawings, which are described below. The embodiments disclosed herein are not intended to be exhaustive or limit the present disclosure to the precise form disclosed in the following detailed description. Rather, the embodiments are chosen and described so that others skilled in the art may utilize their teachings. Therefore, no limitation of the scope of the present disclosure is thereby intended. Corresponding reference characters indicate corresponding parts throughout the several views.

The embodiments disclosed herein may be used with any type of aquatic vessel, including pontoon boats, single hull boats, and other types of aquatic vessels. An exemplary aquatic vessel, a pontoon boat 100 is provided as an example.

Referring to FIG. 1A, an exemplary pontoon boat 100 is floating in a body of water 10 having a top surface 12. Pontoon boat 100 includes a deck 104 supported by a plurality of pontoons 106. The deck supports a railing 108 including a gate 110 positioned in a bow portion 112 (see FIG. 2) of pontoon boat 100. Pontoon boat 100 may further include a plurality of seats 114, a canopy (not shown), and other components supported by deck 104.

Figure 2:
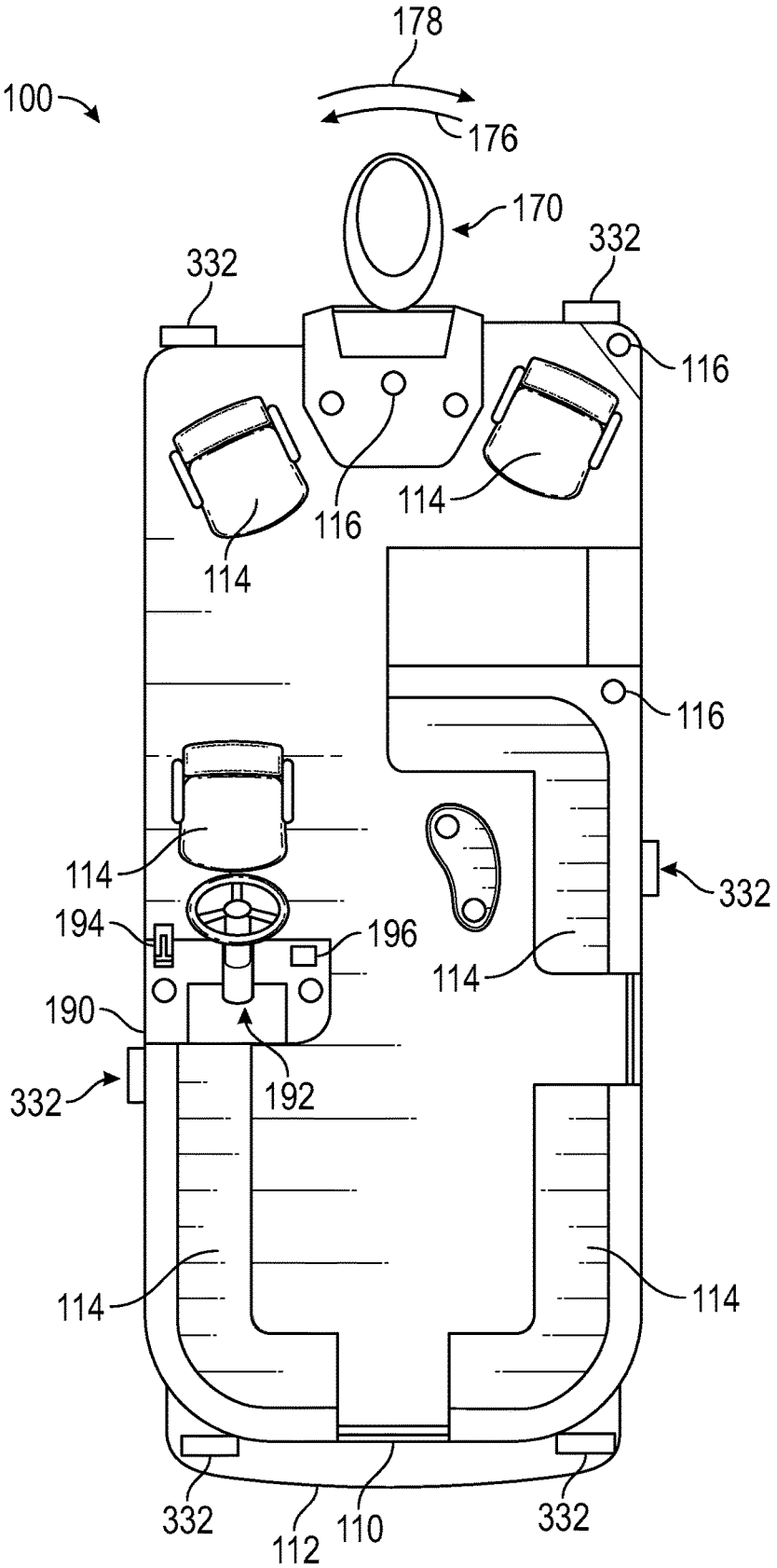
FIG. 2 illustrates a top view of a pontoon boat having a deck and seating.

Referring to FIG. 2, one contemplated arrangement of seating 114 on deck 104 is illustrated. Other arrangements are also contemplated. As illustrated, pontoon boat 100 further comprises cameras 332, which are placed at the port-bow corner, the port-stern corner, the starboard-bow corner, the starboard-stern corner, and both longitudinal sides of pontoon boat 100. In one example, pontoon boat 100 may include a 360 degree view camera, for example as may be positioned on top of a canopy support of pontoon boat 100.

It will be appreciated that any of a variety of additional or alternative sensors may be used in locations similar to cameras 332, including, but not limited to, magnetometers, gyroscopes, lidar systems, radar systems, ultrasound systems, piezo tubes, echo sounder, sonic pulse, acoustic Doppler, sonar, Inertial Measurement Units (IMUs), millimeter wave systems, and other suitable sensor systems to identify environmental objects such as docks, boats, buoys, water bottoms, fish, and other objects. For example, a combination of such sensors may be used, such that each of the illustrated locations comprises one or more such sensors. Further, the locations of cameras 332 are illustrated as examples and, in other examples, alternative, additional, or fewer locations may be used.

FIG. 2 further illustrates an operator console 190 having a plurality of operator controls including a steering input, illustratively steering wheel 192, and throttle control, illustratively a throttle lever 194, and a thruster input, illustratively thruster input control 196, among other exemplary controls. As an example, steering wheel 192 and throttle lever 194 may be used to control outboard motor 170, while thruster input control 196 may be used to control a thruster system of pontoon boat 100, such as thruster system 300 (e.g., depicted in FIG. 3 as comprising forward thruster 302 and aft thruster 304). Additional aspects of thruster system 300 are discussed below in greater detail.

Returning to FIG. 1A, the plurality of pontoons 106 include a starboard pontoon 120, a port pontoon 122, and a central pontoon 124. Each of 1 pontoon 120, port pontoon 122, and central pontoon 124 support deck 104 through respective brackets 126. Each of starboard pontoon 120, port pontoon 122, and central pontoon 124 support deck 104 above top surface 12 of water 10.

Figure 1B:
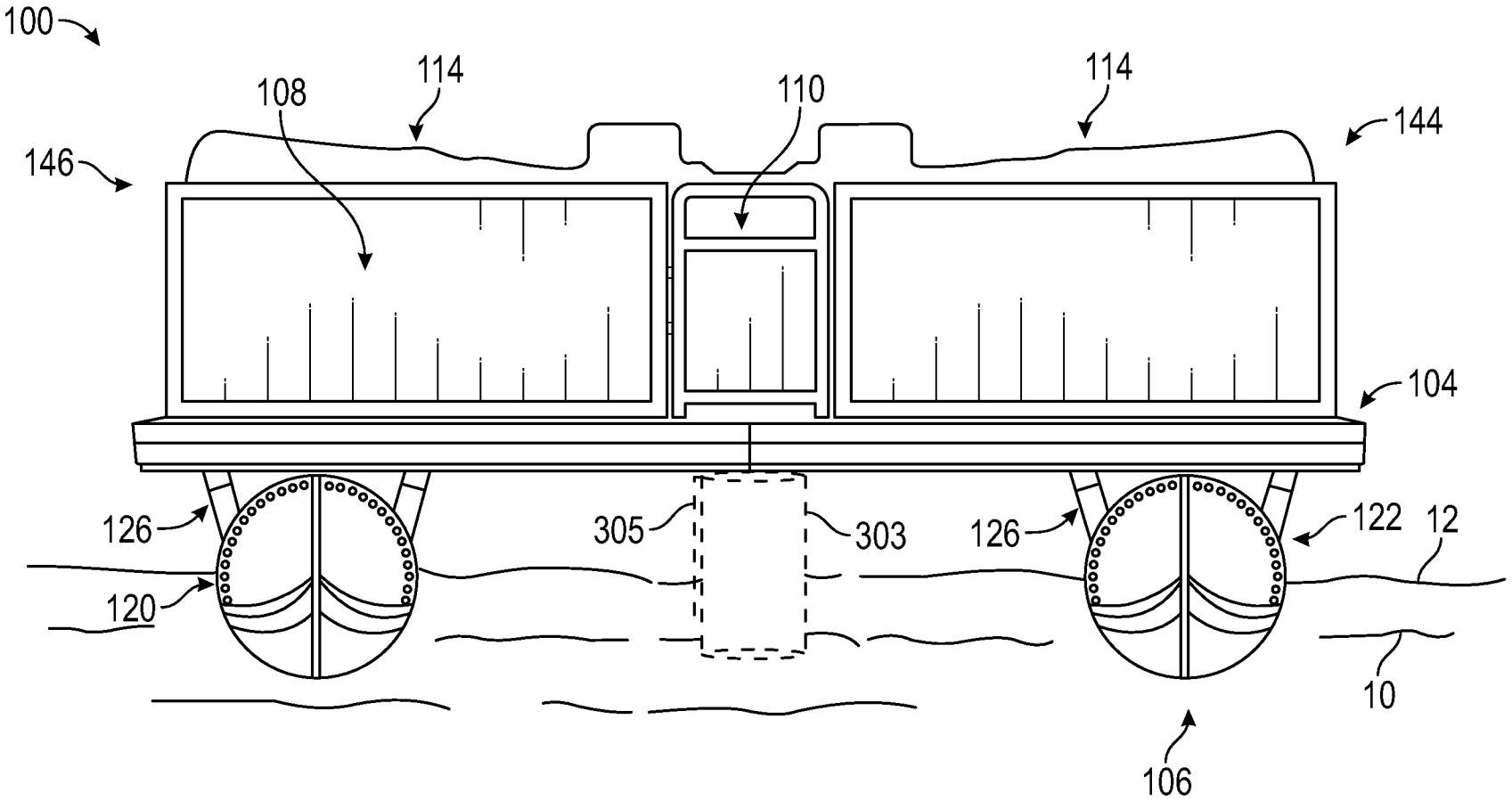
FIG. 1B illustrates a front view of another pontoon boat having a deck supported by two pontoons.

Although three pontoons are illustrated in FIG. 1A, the plurality of pontoons 106 may be limited to two pontoons or have four or more pontoons. For example, FIG. 1B illustrates another example where central pontoon 124 is omitted, such that deck 104 is supported by starboard pontoon 120 and port pontoon 122. Further, although the plurality of pontoons 106 are illustrated as running a full length of pontoon boat 100, in embodiments, one or more of plurality of pontoons 106 are divided into a bow portion pontoon and a stern portion pontoon. It will be appreciated that the thruster systems described herein may be used with other types of aquatic vessels, such as a single hull vessel.

Figure 3A:
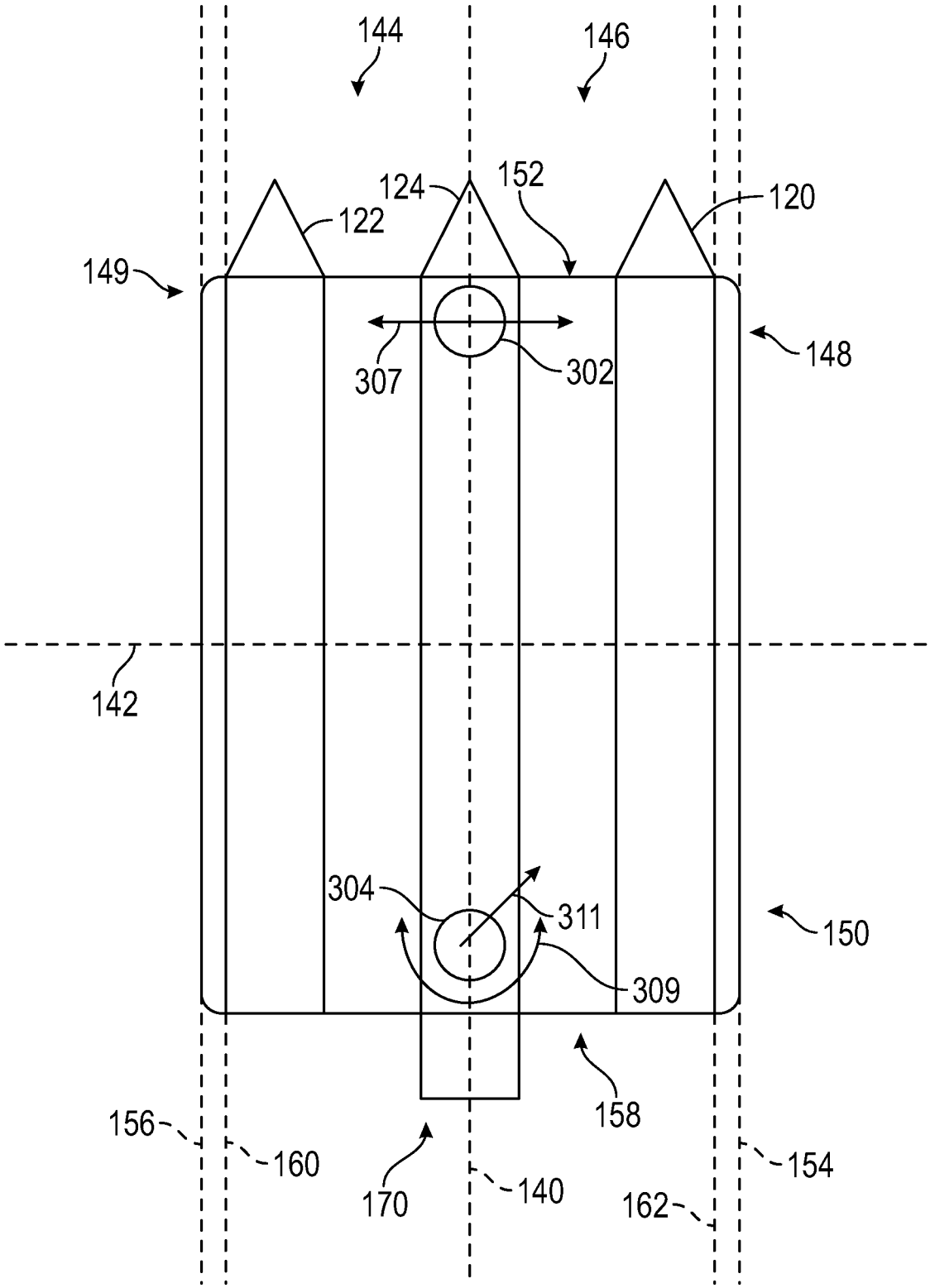
FIG. 3A illustrates a representative top view of the pontoon boat of FIG. 1A including a thruster system according to aspects of the present disclosure.

Referring to FIG. 3A, pontoon boat 100 has a longitudinal centerline 140 and a lateral centerline 142. Longitudinal centerline 140 divides pontoon boat 100 into a port side 144 of pontoon boat 100 and a starboard side 146 of pontoon boat 100. Lateral centerline 142 divides pontoon boat 100 into a bow portion 148 of pontoon boat 100 and a stern portion 150 of pontoon boat 100. Deck 104 of pontoon boat 100 includes an outer perimeter 149 including a bow perimeter portion 152, a starboard perimeter portion 154, a stern perimeter portion 158, and a port perimeter portion 156. The plurality of pontoons 106 define a port extreme extent 160 corresponding to an outer extent of port pontoon 122 and a starboard extreme extent 162 corresponding to an outer extent of starboard pontoon 120.

Pontoon boat 100 includes an outboard motor 170 which extends beyond stern perimeter portion 158 of deck 104. In embodiments, outboard motor 170 is an internal combustion engine which powers rotation of a propeller (not shown). The propeller may be rotated in a first direction to propel pontoon boat 100 forward in a direction 172 or in a second direction to propel pontoon boat 100 rearward in a direction 174. In embodiments, outboard motor 170 is rotatably mounted relative to deck 104 such that an orientation of the propeller may be adjusted to turn pontoon boat 100 in one of direction 176 and direction 178. In embodiments, multiple outboard motors 170 may be provided. In one example, the multiple outboard motors 170 may be positioned adjacent the stern perimeter portion 158 of pontoon boat 100. Although the illustrated embodiment is an outboard motor 170, motor 170 may also be an inboard motor positioned at least partially within perimeter 149 of pontoon boat 100. As another example, any number of outboard motors may be used.

FIG. 3A further includes forward thruster 302 and aft thruster 304, which form a part of thruster system 300. In examples, thruster system 300 may enable greater maneuverability of pontoon boat 100 as compared to outboard motor 170. For example, forward thruster 302 and/or aft thruster 304 may each be steerable to enable an operator to control an associated thrust vector. For instance, forward thruster 302 may be a fixed thruster having available thrust vectors 307, where aft thruster 304 may be operated in forward (e.g., to generate thrust toward starboard side 146 of pontoon boat 100) or reverse (e.g., to generate thrust toward port side 144). Thus, thrust generated by forward thruster 302 may be substantially perpendicular to longitudinal centerline 140 of pontoon boat 100. By contrast, aft thruster 304 may be a steerable thruster that is rotatable about an associated z-axis, as illustrated by arrow 309, to control thrust vector 311 accordingly.

It will be appreciated that while thruster system 300 is illustrated as comprising one fixed thruster and one steerable thruster in FIG. 3A, any combination and configuration of such thrusters may be used. Further, a pontoon boat need not be limited to two thrusters and may comprise additional or fewer thrusters in other examples.

Forward thruster 302 and/or aft thruster 304 may each be positionable within central pontoon 124. As an example, forward thruster 302 and/or aft thruster 304 may have one or more "in-use" positions that are at least partially below the top surface 12 of water 10. By contrast, a "deactivated" position may position forward thruster 302 and/or aft thruster 304 in a way that reduces the likelihood of damage and/or interference (e.g., with a trailer of pontoon boat 100 or when pontoon boat 100 is operating under the power of outboard motor 170). For instance, thrusters 302 and 304 may be retracted within central pontoon 124. As a further example, a thruster may have multiple in-use positions, where the thruster operates as a steerable thruster in an in-use steerable position (e.g., when the thruster is fully extended) and instead operates as a fixed thruster in an in-use fixed position (e.g., when the thruster is partially retracted). Additional aspects relating to such thruster arrangements are described by U.S. application Ser. No. 16/889,272, titled "THRUSTER ARRANGEMENT FOR A BOAT," the entirety of which is hereby incorporated by reference.

Figure 3B:
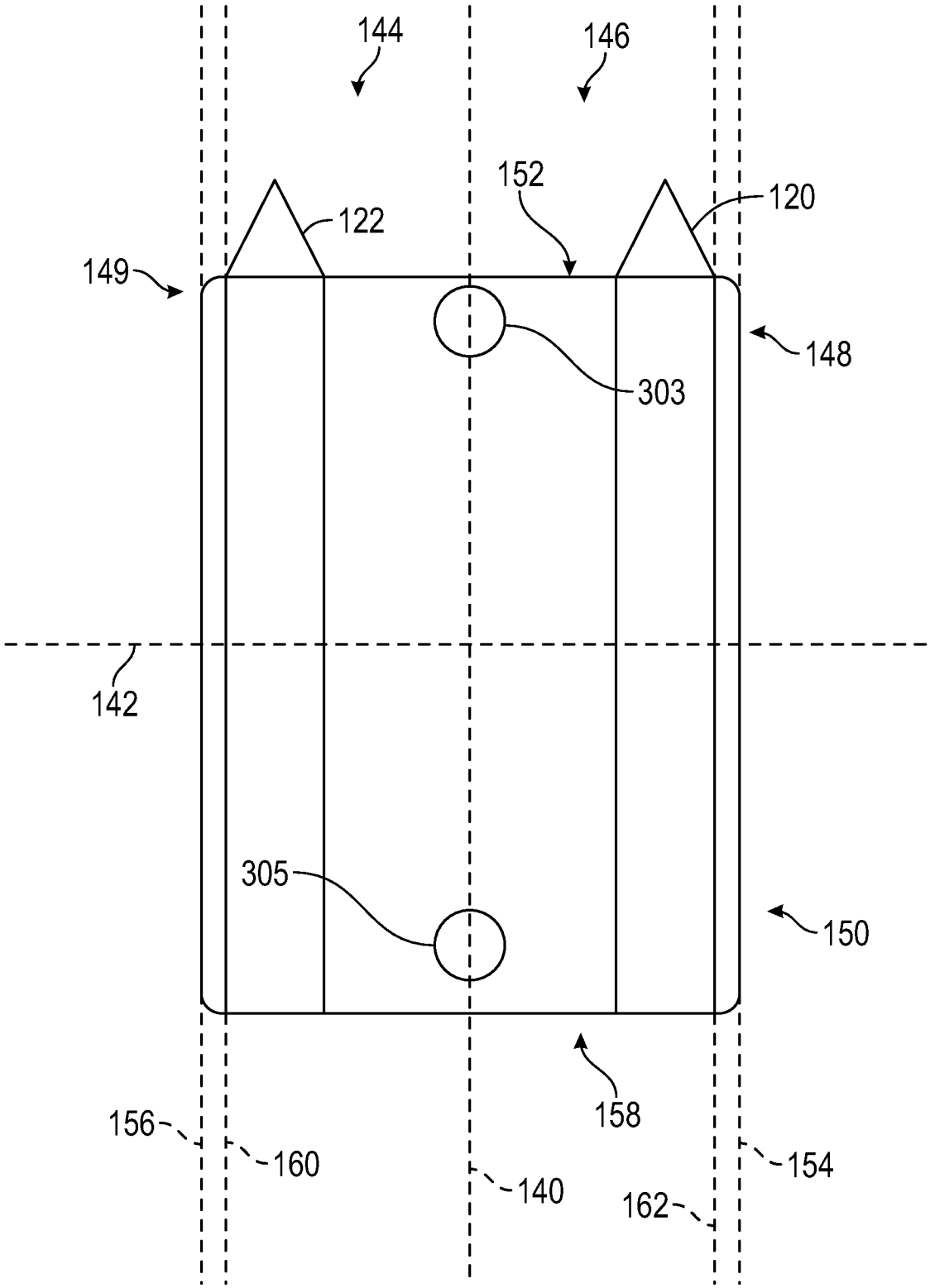
FIG. 3B illustrates a representative top view of the pontoon boat of FIG. 1B including another thruster system according to aspects of the present disclosure.

Thruster placement need not be limited to within one or more pontoons of pontoon boat 100 (e.g., pontoons 122 and 120 in the instant example). For example, FIGS. 1B and 3B illustrate an example where structures 303 and 305 are positioned along longitudinal center line 140 to house or otherwise couple a forward thruster and an aft thruster, respectively, to pontoon boat 100. In such examples, structures 303 and 305 may each permit rotation of a thruster into the water 10. For instance, a retracted position may be a position in which a thruster is substantially parallel to deck 104. The thruster may be rotated toward water 10 in one or more in-use configurations, thereby increasing an angle formed between the thruster and deck 104, and causing the thruster to enter water 10 and/or increase its depth with respect to top surface 12.

It will be appreciated that any of a variety of other techniques may be used to couple, deploy, and/or retract a thruster. As another example, structures 303 and 305 may each permit linear actuation of a thruster, such that the thruster may be raised and lowered along an axis substantially perpendicular to deck 104.

Figure 3C:
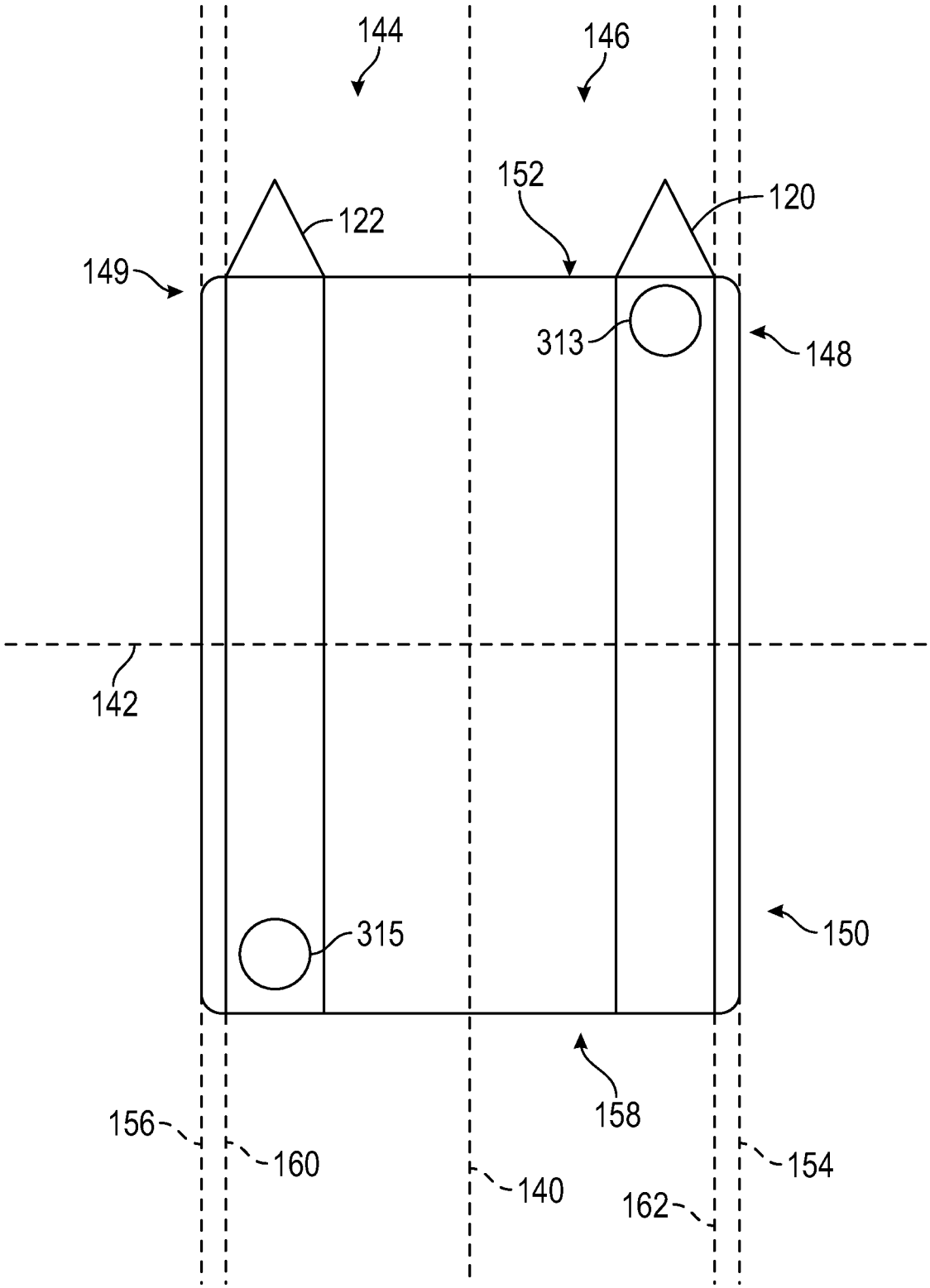
FIG. 3C illustrates a representative top view of the pontoon boat of FIG. 1B including yet another thruster system according to aspects of the present disclosure.

Similarly, while FIGS. 3A and 3B illustrate examples in which thrusters are positioned along longitudinal centerline 140 (e.g., with or without central pontoon 124), thrusters may be positioned according to any of a variety of other paradigms. For example, a staggered configuration is illustrated in FIG. 3C, where starboard pontoon 120 comprises forward thruster 313, while port pontoon 122 comprises aft thruster 315. Additionally, thrusters of thruster system 300 need not be equally spaced apart from lateral centerline 142 and any combination of in-pontoon thrusters (e.g., thrusters 302, 304, 313, and 315) and external thrusters (e.g., as discussed above with respect to structures 303 and 305) may be used.

Figure 5:
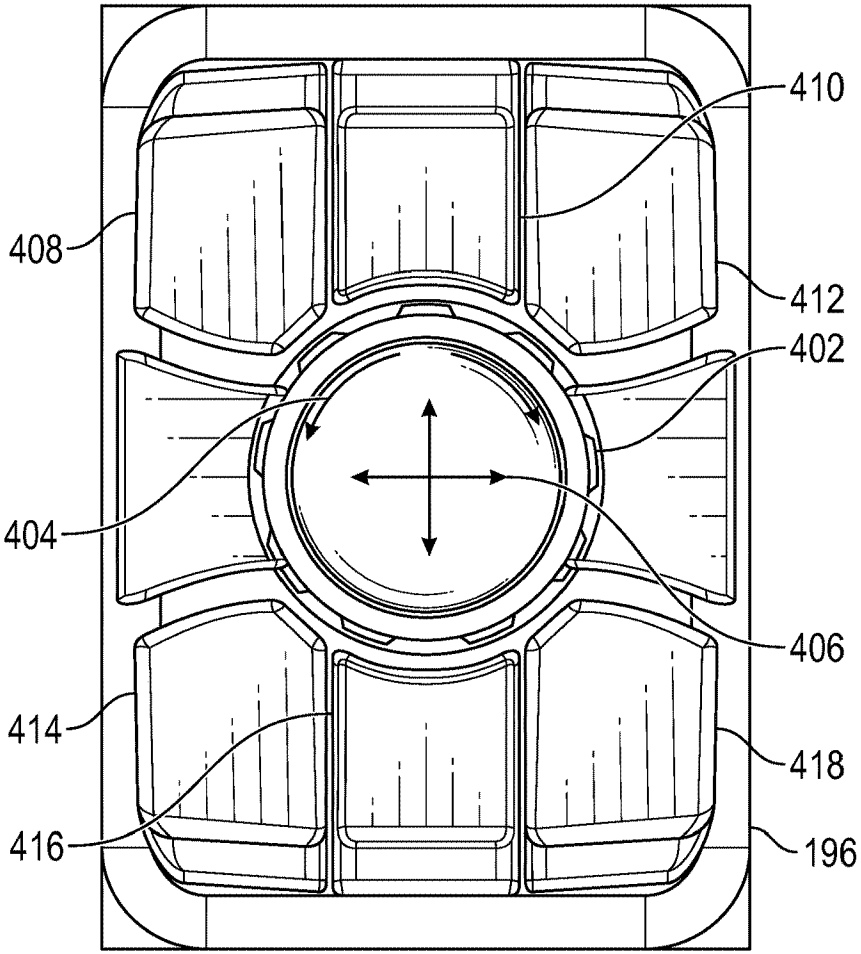
FIG. 5 illustrates a top view of the example thruster input control of FIG. 4.
Figure 4:
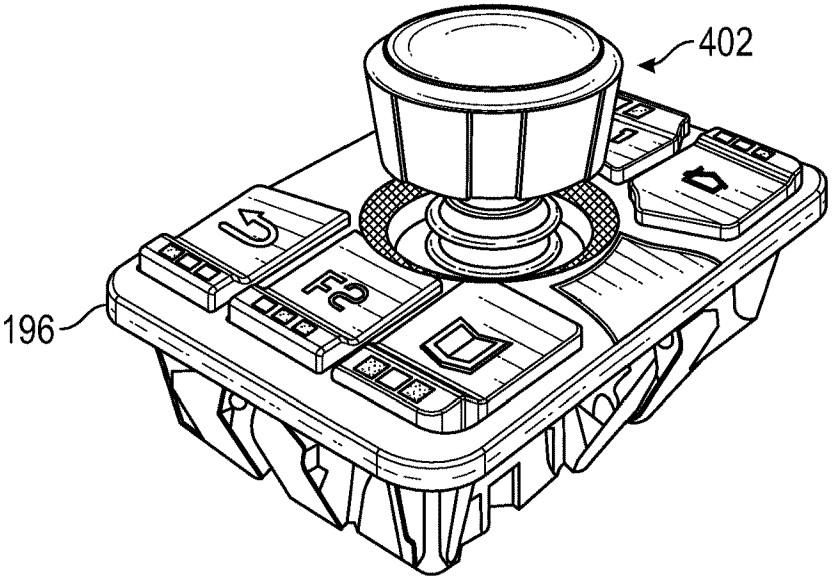
FIG. 4 illustrates a perspective view of an example thruster input control for controlling a thruster system.

FIG. 4 illustrates a perspective view of an example thruster input control 196 for controlling a thruster system, while FIG. 5 illustrates a top view of the example thruster input control 196. As illustrated, thruster input control 196 comprises joystick 402, which may be used by an operator to input an indication of a rotation (e.g., as illustrated by arrows 404) and/or a direction (e.g., as illustrated by arrows 406). As an example, rotational input received via joystick 402 may be momentary, while directional input received via joystick 402 may be proportional. It will be appreciated that, in other examples, rotational input may be proportional and directional input may be momentary, among any of a variety of other combinations.

Thruster input control 196 further comprises lower button 408, enable button 410, raise button 412, drift control button 414, speed button 416, and dock hold button 418. In examples, lower button 408 and raise button 412 may be used to control a position of forward thruster 302 and aft thruster 304. For example, lower button 408 may be used to position thrusters 302 and 304 from a deactivated position to an in-use position, as described above. Enable button 410 may be used to enable manual control of thruster system 300 using joystick 402, thereby enabling the operator to cause rotation and/or movement of pontoon boat 100 along one or more axes.

Drift control button 414 may enable automatic control of thruster system 300, such that thrusters 302 and 304 are used to maintain the position and/or heading of pontoon boat 100 by counteracting an external force acting on pontoon boat 100 (e.g., wind and/or water current). Similarly, dock hold button 418 may maintain the position and heading of pontoon boat 100, for example with respect to a detected object such as a dock. The object may be detected using cameras 332 discussed above with respect to FIG. 2, based on map data and an associated GPS location of pontoon boat 100, and/or using a distance sensor, among other examples.

Speed button 416 may control a relative speed or relative amount of thrust generated by thruster system 300. As an example, thruster system 300 may have a set of associated speeds (e.g., fast, normal, and slow), such that speed button 416 may be used to cycle through the speeds. Speed button 416 may comprise an indicator, such as a set of lights that indicates the speed currently in use by thruster system 300. Thus, when user input is received via joystick 402, the resulting thrust generated by thruster system 300 may be scaled according to the speed that has been selected using speed button 416.

It will be appreciated that a thruster input control may have additional, alternative, or fewer buttons. As another example, a different input control may be used in addition to or as an alternative to joystick 402. For example, a touch sensitive surface may be used to receive user input and identify a directional and/or rotational input accordingly. As another example, a directional control pad may be used. Further, while a single thruster input control 196 is depicted in FIG. 2 in an example where thruster input control 196 is included in operator console 190, similar techniques may be applied to instances where there are multiple thruster input controls (e.g., at the forward and aft of pontoon boat 100) and/or when there is a removable input control.

For example, thruster input control 196 may be removably attached to operator console 190, such that an operator may detach thruster input control 196. Thus, the operator may use thruster input control 196 to control thruster system 300 when away from operator console 190, as may be the case when maneuvering pontoon boat 100 around obstacles or when docking or trailering pontoon boat 100. Thruster input control 196 may be shaped similar to pontoon boat 100 or may otherwise include a visual or tactile indication as to which region of the input control 196 is associated with a forward region (and/or other region) of pontoon boat 100.

As another example, thruster input control 196 may be attachable at any of a variety of other locations (e.g., within pontoon boat 100), for example in one of cup holders 116 in FIG. 2. In such an example, thruster input control 196 and a cup holder 116 may index with one another such that thruster input control 196 is correctly oriented with respect to pontoon boat 100 (e.g., such that forward input received by joystick 402 causes forward movement of pontoon boat 100). In other examples, the input received by thruster input control 196 may be adapted based on an orientation and/or rotation of thruster input control 196 with respect to pontoon boat 100.

Figure 6:
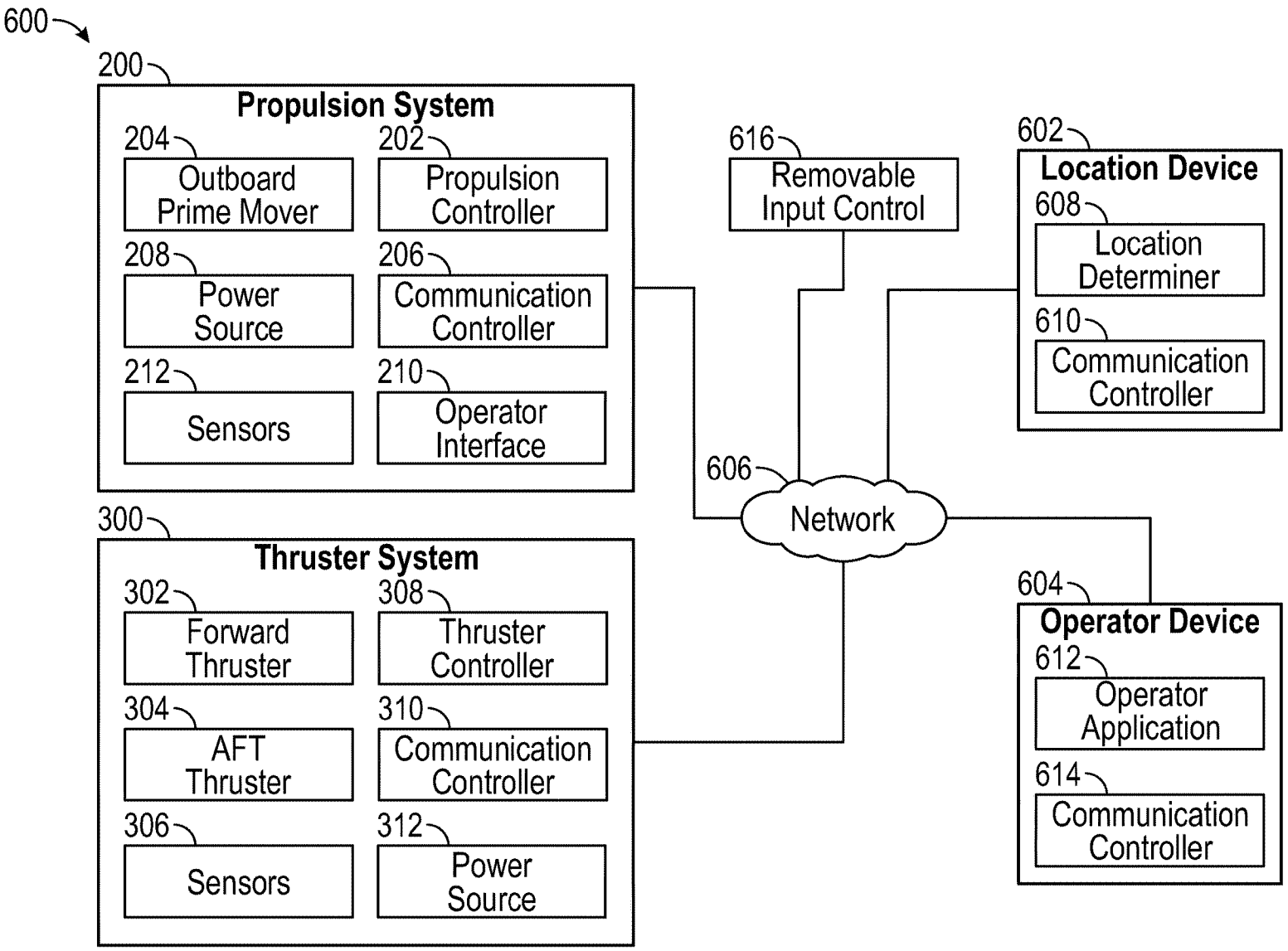
FIG. 6 illustrates a block diagram of example control systems for a pontoon boat as described herein.

FIG. 6 illustrates a block diagram 600 of example control systems of the pontoon boat of FIGS. 1A-B. As illustrated, propulsion system 200 of pontoon boat 100 comprises outboard prime mover 204, propulsion controller 202, power source 208, communication controller 206, operator interface 210, and sensors 212.

Propulsion system 200 includes a prime mover 204, illustratively outboard motor 170 in FIG. 2. Exemplary prime movers include outboard style motors, inboard style motors, internal combustion engines, two stroke internal combustion engines, four stroke internal combustion engines, diesel engines, electric motors, hybrid engines, jet powered engines, and other suitable sources of motive force. Propulsion system 200 further includes a power source 208. The type of power source may depend on the type of prime mover used. In embodiments, the prime mover is an internal combustion engine and the power source is one of a pull start system and an electric start system. Propulsion system 200, in the case of an internal combustion engine, would further include a fuel system and air intake system which provide fuel and air to the internal combustion engine. In embodiments, the prime mover 204 is an electric motor and power source 208 is a switch system which electrically couples one or more batteries to the electric motor. In embodiments, the prime mover 204 is a jet based engine which requires an auxiliary pump and/or water intake system.

Propulsion controller 202 may control outboard prime mover 204 according to operator input (e.g., as may be received via steering wheel 192 and/or throttle lever 194). Thus, propulsion controller 202 may control an orientation of outboard prime mover 204. Similarly, propulsion controller 202 may control thrust generated by outboard prime mover 204. As an example, a hydraulic system (not shown) may be used, which orients outboard motor 170 relative to deck 104. By turning outboard motor 170 relative to deck 104 a direction of travel of pontoon boat 100 may be altered. In embodiments, outboard motor 170 is stationary and pontoon boat 100 includes a separate rudder which is oriented relative to deck 104 to steer pontoon boat 100.

In examples, propulsion controller 202 processes data obtained by sensors 212, including, but not limited to, camera systems, stereo camera systems, location determiners such as GPS systems, accelerometers, magnetometers, gyroscopes, lidar systems, radar systems, ultrasound systems, piezo tubes, echo sounder, sonic pulse, acoustic Doppler, sonar, Inertial Measurement Units (IMUs), millimeter wave systems, and other suitable sensor systems to identify environmental objects such as docks, boats, buoys, water bottoms, fish, and other objects. It will be appreciated that any of a variety of additional or alternative sensors may be used, such as a tachometer to measure the revolutions-per-minute (RPM) of outboard prime mover 204 or a speed sensor to determine a speed with which pontoon boat 100 is travelling.

Operator interface 210 includes at least one input device and at least one output device. Exemplary input devices include levers, buttons, switches, soft keys, and other suitable input devices, as may be located in an operator console, such as operator console 190. Exemplary output devices include lights, displays, audio devices, tactile devices, and other suitable output devices. In embodiments, the output devices include a display and information may be formatted and presented on the display. In one embodiment, input devices and output devices include a touch display and information may be formatted and presented on the touch display. Exemplary operator inputs include a touch, a drag, a swipe, a pinch, a spread, and other known types of gesturing.

Communication controller 206 communicates over network 606. Network 606 may include a wired and/or wireless network. As an example, network 606 includes a CAN network, such that communication controller 206 is used by propulsion controller 202 to communicate with elements of pontoon boat 100. In one embodiment, the CAN network is implemented in accord with the J1939 protocol. Details regarding an exemplary CAN network are disclosed in U.S. patent application Ser. No. 11/218,163, filed Sep. 1, 2005, and published as U.S. Published Patent Application No. US2007/0050095, the entire disclosure of which is expressly incorporated by reference herein. Of course, any suitable type of network or data bus may be used in place of the CAN network. For example, network 606 may include a NMEA 2000 bus, as may be implemented in accordance with the IEC 61162-3 standard. In one embodiment, two wire serial communication is used. As another example, communication controller 206 may communicate via network 606 using Ethernet, Wi-Fi, and/or Bluetooth. While FIG. 6 is illustrated as comprising a single network 606, it will be appreciated that such network communications may be among controllers of pontoon boat 100 (e.g., via a bus) and/or with devices external to pontoon boat 100 (e.g., via Wi-Fi or Bluetooth), such as operator device 604, among other examples.

Thruster system 300 is illustrated as comprising forward thruster 302, aft thruster 304, sensors 306, thruster controller 308, communication controller 310, and power source 312. Similar to outboard prime mover 204, thrusters 302 and 304 may be any of a variety of motors or engines, such that power source 312 may be a corresponding power source. For example, thrusters 302 and 304 may each comprise electric motors, such that power source 312 provides electrical energy for their operation. As an example, thruster system 300 may be used to maneuver pontoon boat 100 as an alternative to outboard prime mover 204 or, as another example, outboard prime mover 204 and thruster system 300 may be used together. For instance, thruster system 300 may be used instead of outboard prime mover 204 when docking pontoon boat 100.

In examples, thruster controller 308 controls operation of forward thruster 302 and aft thruster 304. For instance, thruster controller 308 may control a position, rotation, and/or thrust vector generated by thruster 302 and/or 304. For example, thruster controller 308 may communicate with thrusters 302 and 304 via a bus of network 606. As a result, thruster system 300 may be scalable to any number of thrusters, such that thruster controller 308 may communicate (e.g., via communication controller 310) with and therefore control such thrusters via the bus. In other examples, thruster controller 308 may more directly communicate with thrusters 302 and 304 (e.g., via a wired connection or via wireless communication).

In examples, input to control thrusters 302 and 304 is received from removable input control 616, aspects of which may be similar to thruster input control 196. In other examples, an operator may use operator device 604 to control thruster system 300 via operator application 612. In such instances, thruster system 300 and operator device 604 may communicate via network 606 using communication controller 310 and communication controller 614, respectively. For example, operator application 612 may display information associated with thruster system 300, including, but not limited to, whether thrusters 302 and 304 are deployed, a state of charge of power source 312, information associated with sensors 306 (e.g., identified obstacles or a camera feed associated with a direction of travel), and a speed and/or direction of travel. Operator application 612 may be used by an operator to deploy thrusters 302 and 304, as well as to control thrust generated by thrusters 302 and 304 accordingly. Example user experience aspects are discussed in greater detail below with respect to FIGS. 12A-C. While such aspects are described with respect to operator application 612 of operator device 604, it will be appreciated that similar aspects may be used in instances where operator console 190 includes a display with which such information may be presented and/or operator input may be received.

Sensors 306 may include any of a variety of sensors, similar to sensors 212 described above. In examples, sensors 212 includes an IMU, which thruster controller 308 may use to identify external forces acting on pontoon boat 100. For example, thruster controller 308 may account for external forces when controlling thrusters 302 and 304 according to received operator input. In such examples, a target vector associated with operator input may be adapted according to identified external forces, such that an operator need not oversteer when a strong wind and/or water current is present. It will be appreciated that an IMU is provided as an example and additional or alternative sensors may be used. For example, sensors 306 may include a GPS or other location determiner, such that a geographic location of pontoon boat 100 may be used to identify the presence of such external forces.

Thruster system 300 further comprises communication controller 310, aspects of which are similar to communication controller 206 described above and are therefore not necessarily re-described in detail. In examples, thruster system 300 uses communication controller 310 to communicate with or otherwise receive communications from propulsion system 200. For example, propulsion controller 202 may communicate an engine RPM, speed, battery voltage, or other propulsion system information of propulsion system 200 via network 606.

Accordingly, communication controller 310 of thruster system 300 may be used by thruster controller 308 to obtain such propulsion system information. In examples, thruster controller 308 may identify a deactivation condition, which indicates that thrusters 302 and/or 304 should be placed in a deactivated or retracted position. For example, a battery voltage below a predetermined charge threshold may indicate that power source 208 has been depleted near a point below which outboard prime mover 204 would be unable to operate and/or thrusters 302 and 304 would be unable to be placed into the deactivated position. For instance, the charge threshold may be determined based on a voltage associated with starting outboard prime mover 204 or retracting thrusters 302 and 304 (e.g., whichever is greater). As another example, an engine RPM and/or speed above a predetermined threshold may be associated with conditions that may damage thrusters 302 and 304, such that they may be automatically retracted into the deactivated position. In such instances, speed and/or acceleration may be evaluated. For example, high acceleration may be identified to be a deactivation condition even in low speed. Any of a variety of additional or alternative deactivation conditions may be used in other examples.

As a result of the integration of thruster system 300 with network 606, thruster system 300 may automatically identify and respond to such deactivation conditions. Such aspects may be beneficial in instances where thruster system 300 is provided as an aftermarket addition to pontoon boat 100. For example, thruster system 300 may be electrically coupled with a bus of pontoon boat 100 as part of an installation process, such that thruster system 300 may obtain such information via the bus and perform processing accordingly. Diagram 600 is further illustrated as comprising location device 602, which may be used in instances where sensors 212 and 306 do not include a location determiner. Rather, location device 602 may communicate via network 606 using communication controller 610, such that geographic location and/or speed information generated by location determiner 608 is provided via network 606 accordingly. Thus, thruster system 300 may receive and use information from any of a variety of sources, for example when identifying a deactivation condition.

In some examples, thrusters 302 and 304 may be placed in or remain in an in-use position, even when outboard prime mover 204 is in operation. Similar to the above-described deactivation condition, thruster controller 308 may identify an energy recapture condition. For example, thruster controller 308 may determine a speed and/or acceleration of pontoon boat 100 is below a predetermined recapture threshold or within a predetermined recapture range, such that thrusters 302 and 304 may be placed into or remain in the in-use position. In contrast to instances where the thruster system is used for propulsion, the thruster system may instead be configured to charge an associated power source. In such instances, thrusters 302 and 304 are not powered by power source 312, but may instead be used to generate energy as pontoon boat 100 moves through water 10 (e.g., under the power of outboard prime mover 204), thereby recharging power source 312. In some instances, identification of such an energy recapture condition may further comprise evaluating a voltage or state of charge of power source 312, such that the energy recapture condition may be identified in instances where the state of charge of power source 312 is below a predetermined threshold.

It will be appreciated that deactivation conditions and recapture conditions need not be associated. For example, a recapture threshold may be distinct from a deactivation threshold. In some instances, thrusters 302 and 304 need not be retracted to account for the speed of pontoon boat 100, or such a deactivation condition may occur at a relatively high speed (e.g., below which energy recuperation may occur). In examples, thrusters 302 and 304 may be used for low-speed travel (e.g., while outboard prime mover 204 may be in neutral), while outboard prime mover 204 may be used for high-speed travel. Accordingly, thrusters 302 and 304 may remain in an in-use position while outboard prime mover 204 is in operation at such higher speeds, such that power source 312 may be recharged accordingly.

While diagram 600 is illustrated as comprising systems 200 and 300 (e.g., having controllers 202 and 308, respectively), it will be appreciated that, in other examples, such aspects may be combined or distributed according to any of a variety of other paradigms. For example, thruster controller 308 may be separate from propulsion controller 202 in instances where thruster system 300 is an aftermarket system added to pontoon boat 100. In other examples where pontoon boat 100 is pre-equipped with a thruster system, a central controller may include functionality similar to propulsion controller 202 and thruster controller 308.

Figure 7:
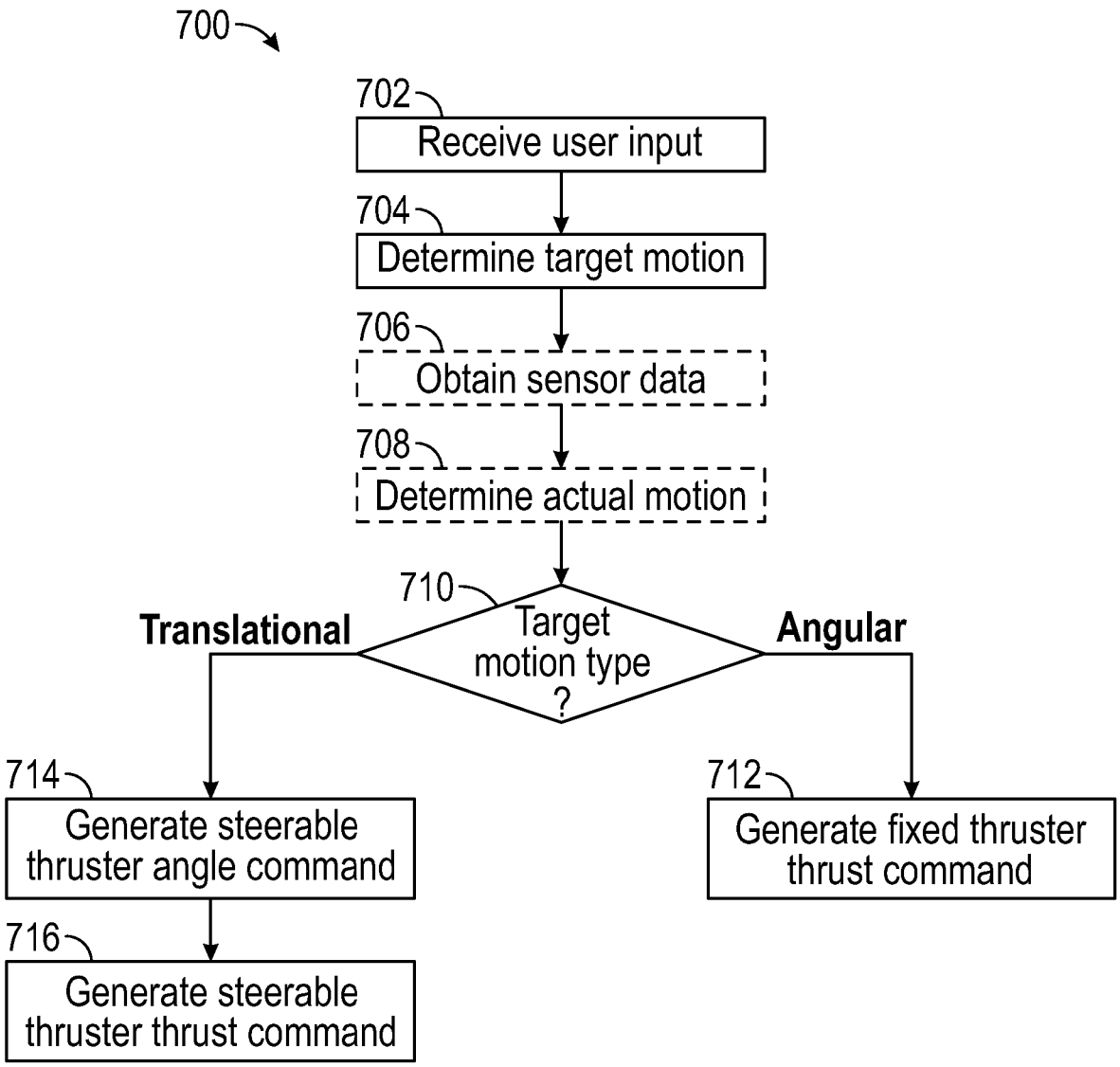
FIG. 7 illustrates an overview of an example method for controlling movement using a set of thrusters.

FIG. 7 illustrates an overview of an example method 700 for controlling movement using a set of thrusters. In examples, aspects of method 700 may be performed by a thruster controller to control a set of thrusters. For example, thruster controller 308 may perform aspects of method 700 to control thrusters 302 and 304. Method 700 is provided as an example method for instances where the set of thrusters comprises a fixed thruster and a steerable thruster, similar to the example discussed above with respect to FIGS. 3A-C.

Method 700 begins at operation 702, where user input is received. In examples, user input is received from a thruster input control, such as thruster input control 196 or removable input control 616. As another example, the user input may be received from an operator device executing an operator application, such as operator application 612 of operator device 604 discussed above with respect to FIG. 6. The user input may comprise an indication of a rotation and/or movement along one or more axes.

Flow progresses to operation 704, where a target motion is determined for the boat. For example, in instances where the received user input comprises an indication to rotate the pontoon boat, the target motion may be determined to be an angular target motion type. As another example, if the received input indicates lateral and/or longitudinal movement, the target movement may be determined to be a translational movement type.

Flow progresses to operation 706, where sensor data is obtained. For example, sensor data may be obtained from sensors 212 and/or sensors 306 discussed above with respect to FIG. 6. In some examples, sensor data may be obtained from a bus or other network using a communication controller, such as communication controller 310 and network 606.

At operation 708, an actual motion is determined for the boat. For example, the actual motion may include an actual angular velocity (e.g., as may be determined by an IMU). As another example, the actual motion may include an actual longitudinal and/or lateral velocity, as may be determined based on a speed and heading of a boat or based on GPS information, among other examples. Operations 706 and 708 are illustrated using dashed boxes to indicate that, in other examples, operations 706 and 708 may be omitted. For example, operations 708 and 710 may be performed to account for external forces acting on the pontoon boat.

At determination 710, flow branches according to the target motion type that was determined at operation 704. If the target motion type is an angular target motion type, flow branches "ANGULAR" to operation 712, where a fixed thruster thrust command is generated. In instances where an actual motion of the boat was determined at operation 708, the thrust command may be generated based on an actual angular velocity, thereby accounting for the existing angular velocity of the boat. Thus, in instances where the received user input indicates a rotation, the thrust command generated at operation 712 controls the angular velocity of the boat accordingly using the fixed thruster. Method 700 terminates at operation 712.

By contrast, in instances where the target motion type is a translational target motion type, flow instead branches "TRANSLATIONAL" to operation 714, where a steerable thruster angle command is generated. The steerable thruster angle command may be generated based on lateral and/or longitudinal motion indicated by the user input that was received at operation 702. In examples, the steerable thruster angle command is generated based on an actual longitudinal and/or lateral velocity, as may have been determined at operation 708.

Flow progresses to operation 716, where a steerable thruster thrust command is generated. Similar to operation 714, the thrust command may be generated based on a magnitude of lateral and/or longitudinal motion indicated by the user input that was received at operation 702. In examples, the steerable thruster angle command is generated based on an actual longitudinal and/or lateral velocity, as may have been determined at operation 708. In some instances, operation 716 further comprises accounting for a speed indicated by a thruster input control, for example as may have been configured by speed button 416 of thruster input control 196 discussed above with respect to FIG. 5. Method 700 terminates at operation 716.

While method 700 is described in an example where user input is received to control a thruster system, it will be appreciated that similar techniques may be used to perform automatic control of the thruster system, for example where an indication of rotational and/or translational movement may instead be received from a controller at operation 702.

Figure 8:
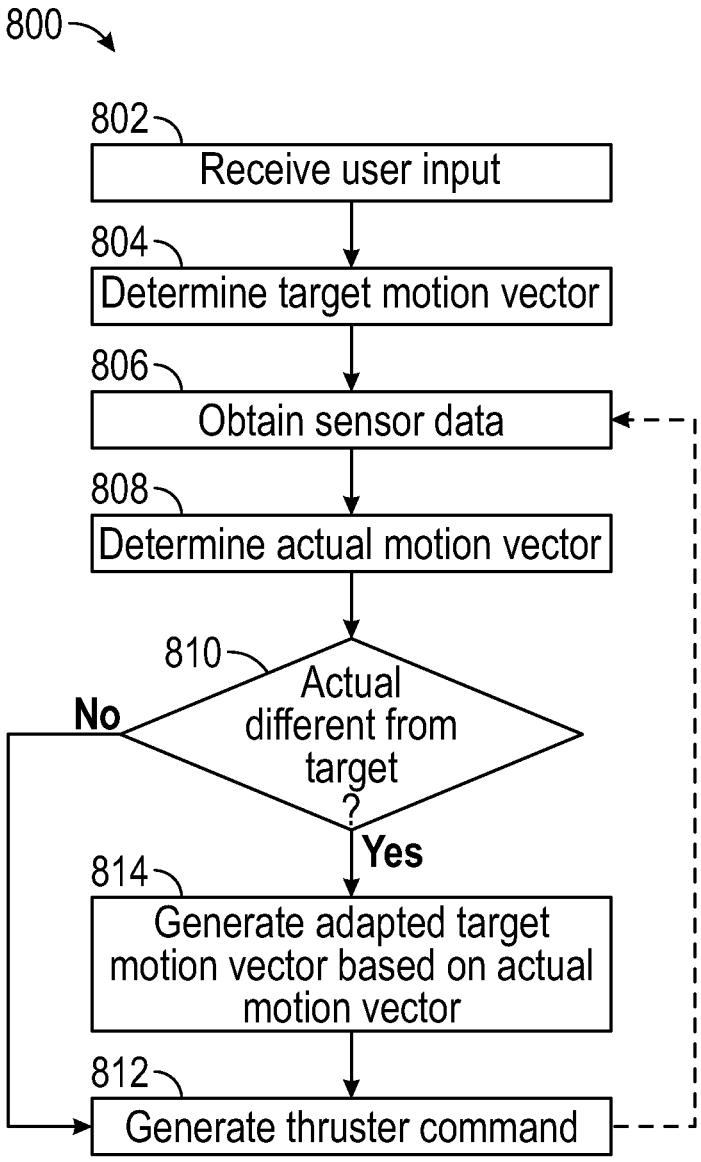
FIG. 8 illustrates an overview of another example method for controlling movement using a set of thrusters based on sensor data according to aspects described herein.

FIG. 8 illustrates an overview of another example method 800 for controlling movement using a set of thrusters based on sensor data according to aspects described herein. In examples, aspects of method 800 may be performed by a thruster controller to control a set of thrusters. For example, thruster controller 308 may perform aspects of method 800 to control thrusters 302 and 304. While method 800 is described in an example where user input is received to control a thruster system, it will be appreciated that similar techniques may be used to perform automatic control of the thruster system.

Method 800 begins at operation 802, where user input is received. In examples, user input is received from a thruster input control, such as thruster input control 196 or removable input control 616. As another example, the user input may be received from an operator device executing an operator application, such as operator application 612 of operator device 604 discussed above with respect to FIG. 6. The user input may comprise an indication of a rotation and/or movement along one or more axes.

Flow progresses to operation 804, where a target motion vector is determined for the boat. For example, the received input may indicate movement having a lateral and/or longitudinal component (e.g., according to arrows 406 in FIG. 5), such that the direction of the target motion vector may be a product of the lateral component and the longitudinal component. Similarly, the received input may indicate a magnitude of the movement, such that the determined target motion vector reflects the indicated magnitude accordingly. Operation 804 may comprise accounting for a speed indicated via a thruster input control, for example as may have been configured by speed button 416 of thruster input control 196 discussed above with respect to FIG. 5.

Flow progresses to operation 806, where sensor data is obtained. For example, sensor data may be obtained from sensors 212 and/or sensors 306 discussed above with respect to FIG. 6. In some examples, sensor data may be obtained from a bus or other network using a communication controller, such as communication controller 310 and network 606. For example, the obtained sensor data may be from an IMU, magnetometer, and/or a GPS device, such that information associated with an external force may be determined.

At operation 808, an actual motion vector is determined for the boat. For example, a speed and heading of the boat may be determined based on the sensor information that was obtained at operation 806.

Flow progresses to determination 810, where it is determined whether the actual motion vector is different from the target motion vector. For example, if one or more external forces are acting on the pontoon boat, the boat's actual motion may differ from that of the target motion. The difference may be with respect to a speed and/or a heading. In examples, a predetermined tolerance may be applied, such that a difference between the actual motion and the target motion within the predetermined tolerance may not be identified as a difference at determination 810.

Accordingly, if a difference is not identified, flow branches "NO" to operation 812, which is discussed below. By contrast, if a difference is identified, flow instead branches "YES" to operation 814, where an adapted target motion vector is generated based on the actual motion vector. For example, the direction and/or magnitude of the target motion vector may be adjusted to reflect the difference between the target motion vector and the actual motion vector. Thus, operation 814 may account for an external force acting on the boat as compared to the direction and/or magnitude that was indicated by the operator at operation 802.

Flow progresses to operation 812, where a thruster command is generated accordingly. The thruster command may comprise an angle and/or magnitude of thrust to be generated by a thruster. In examples, where multiple thrusters are used, multiple thruster commands may be generated, each of which may be different. The generated thruster command(s) may be provided via a bus, as described above with respect to FIG. 6. Flow terminates at operation 812.

A dashed arrow is illustrated from operation 812 to operation 806 to indicate that, in some examples, aspects of method 800 may be performed absent additional or subsequent user input, for example according to a previously determined target motion vector. Thus, operations 806-814 may be performed to maintain a course of the pontoon boat until subsequent user input is received. Thus, multiple iterations of method 800 may be performed, at least some of which may include operation 814 as determined by determination 810.

Figure 9:
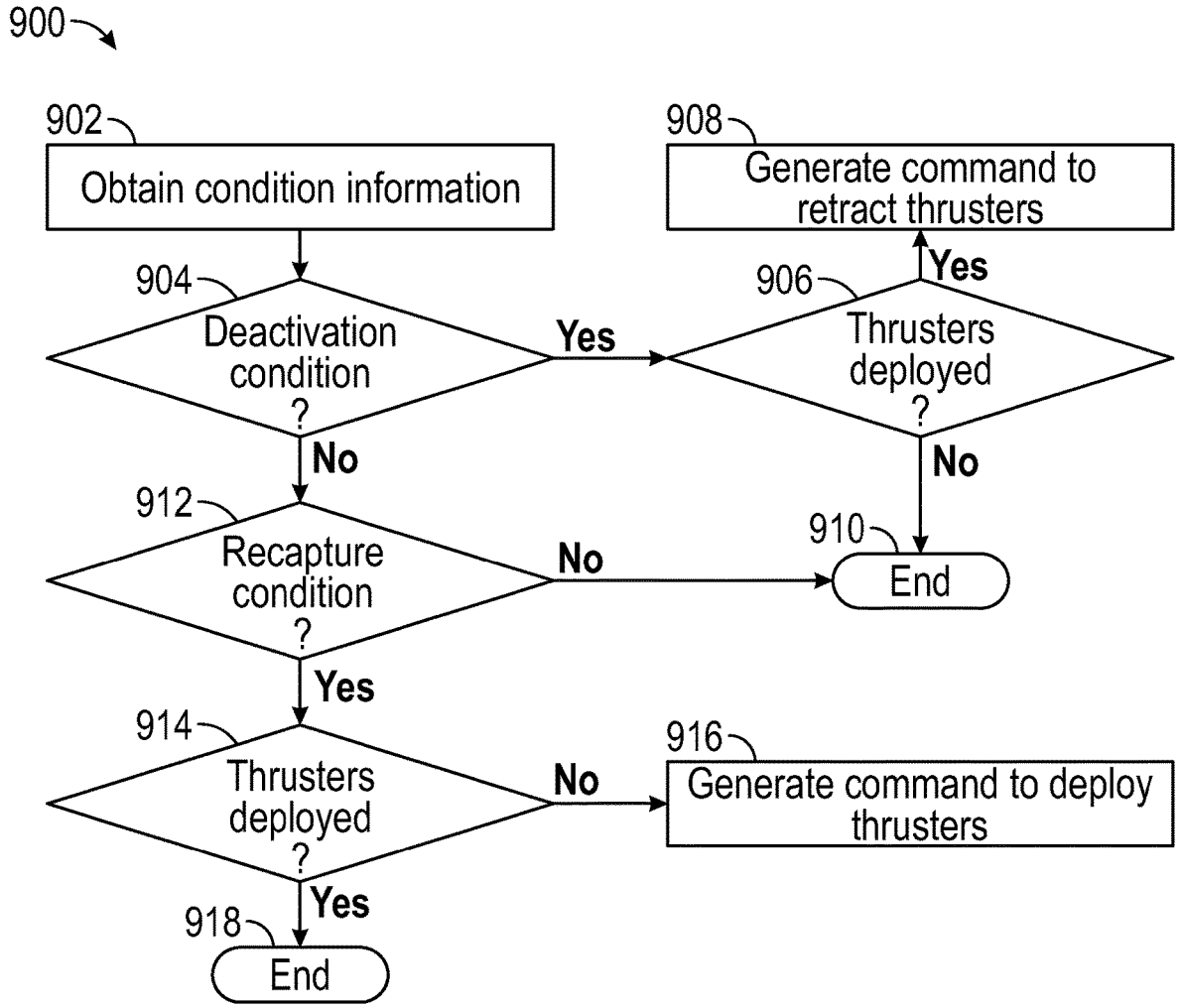
FIG. 9 illustrates an overview of an example method for deploying or retracting thrusters based on identified conditions according to aspects described herein.

FIG. 9 illustrates an overview of an example method for deploying or retracting thrusters based on identified conditions according to aspects described herein. In examples, aspects of method 900 may be performed by a thruster controller to control a set of thrusters. For example, thruster controller 308 may perform aspects of method 800 to control thrusters 302 and 304.

Method 900 begins at operation 902, where condition information is obtained. For example, the condition information may be obtained from a bus of a pontoon boat, as may be obtained from network 606 by communication controller 310 discussed above with respect to FIG. 6. As another example, a thruster system may comprise sensors, such as sensors 306 of thruster system 300. In a further example, the condition information may be obtained from a location device, such as location device 602. The condition information may comprise propulsion system information (e.g., an engine RPM, a speed, or a battery voltage) or GPS information, among other information.

Flow progresses to determination 904, where it is determined whether a deactivation condition is present. For example, the obtained condition information may be evaluated according to one or more deactivation conditions, for example those relating to speed, engine RPM, and/or battery voltage as described above.

Accordingly, if it is determined that a deactivation condition is present, flow branches "YES" to determination 906, where it is determined whether thrusters of the thruster system are deployed. In examples, the determination comprises obtaining information via a bus of the pontoon boat, as may be the case when the thruster controller communicates with the thrusters via the bus. If it is determined that the thrusters are not deployed, flow branches "NO" and ends at operation 910.

However, if it is determined that the thrusters are deployed, flow instead branches "YES" to operation 908, where a command is generated to retract the thrusters. Similar to determination 906, the command may be transmitted via a bus, thereby causing the thrusters to retract to a deactivated position. Method 900 terminates at operation 908.

Returning to determination 904, if it is instead determined that a deactivation condition is not present, flow branches "NO" to determination 912, where it is determined whether a recapture condition is present. For example, it may be determined that a speed and/or acceleration of the pontoon boat is below a predetermined recapture threshold or within a predetermined recapture range. As another example, determination 912 may comprise determining that a state of charge of a thruster system power source (e.g., power source 312 of thruster system 300 discussed above with respect to FIG. 6) is below a predetermined threshold.

If it is determined that a recapture condition is not present, flow branches "NO" at terminates at operation 910. By contrast, if it is instead determined that a recapture condition is present, flow branches "YES" to operation 914, where it is determined whether thrusters of the thruster system are deployed. Such aspects are similar to determination 906 and are therefore not re-described in detail. If it is determined that the thrusters are not deployed, flow branches "NO" to operation 916, where a command is generated to deploy the thrusters. Similar to determination 906 and 914, the command may be transmitted via a bus, thereby causing the thrusters to deploy. In examples, the command comprises an indication as to a position to which the thrusters should deploy. For example, the thrusters may be deployed at a reduced depth as compared to an in-use position as described herein. Method 900 terminates at operation 916.

Returning to determination 914, if it is determined that the thrusters are already deployed, flow instead branches "YES" and terminates at operation 918. It will be appreciated that example conditions are described and that, in other examples, any of a variety of additional or alternative conditions and associated condition information may be used to automatically deploy and/or retract thrusters of a thruster system.

Figure 11:
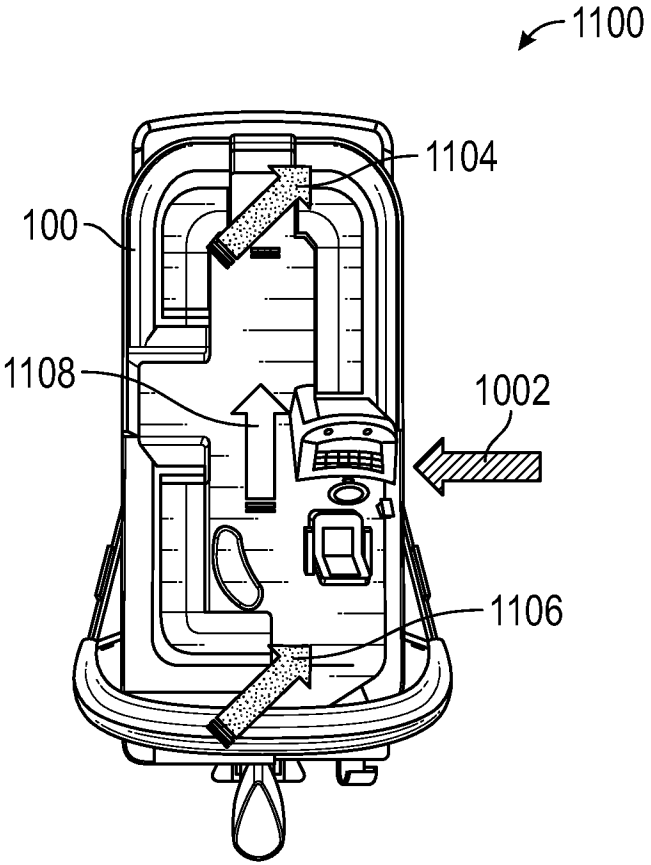
FIGS. 10 and 11 illustrate example thruster system behavior of a pontoon boat in instances where an external force is present.
Figure 10:
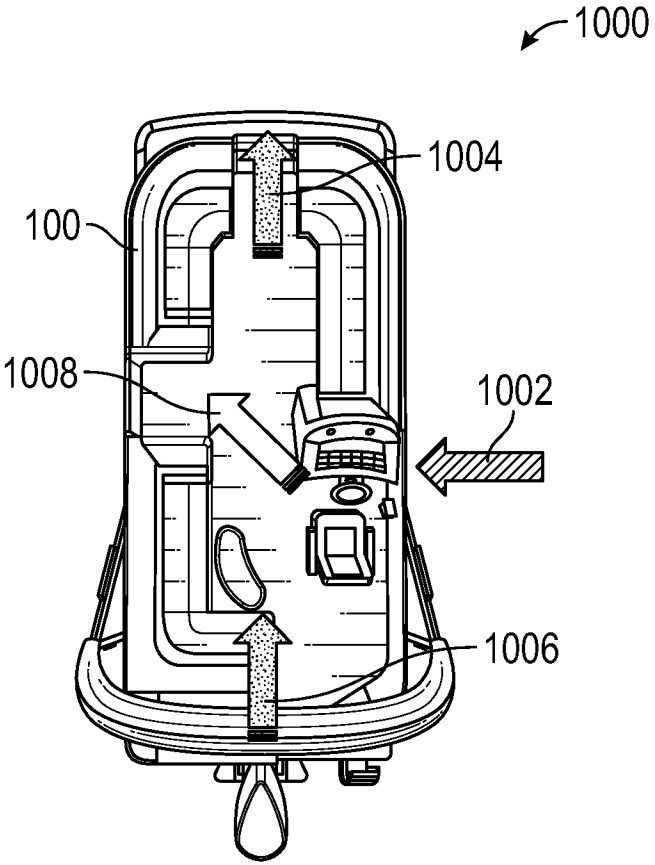

FIGS. 10 and 11 illustrate example thruster system behavior of a pontoon boat in instances where an external force is present. Referring first to FIG. 10, view 1000 illustrates that pontoon boat 100 is experiencing an external force, as illustrated by arrow 1002. Similar to FIGS. 3A-C, pontoon boat 100 is equipped with two thrusters, each of which are generating thrust to propel pontoon boat 100, as illustrated by arrows 1004 and 1006. However, rather than traveling in a forward direction (e.g., parallel to arrows 1004 and 1006), pontoon boat 100 instead travels in a direction parallel to arrow 1008 as a result of the external force.

By contrast, view 1100 of FIG. 11 illustrates an example where a thruster controller applies aspects similar to those discussed above with respect to method 800 of FIG. 8. Accordingly, in the presence of the same external force discussed above in FIG. 10, thrusters instead propel pontoon boat 100 in a direction that accounts for the external force, as illustrated by arrows 1104 and 1106. Thus, as compared to arrows 1004 and 1006 of FIG. 10, the thrusters have been adapted to account for the external force, such that pontoon boat 100 travels in a direction that is parallel 1108.

Figure 12A:
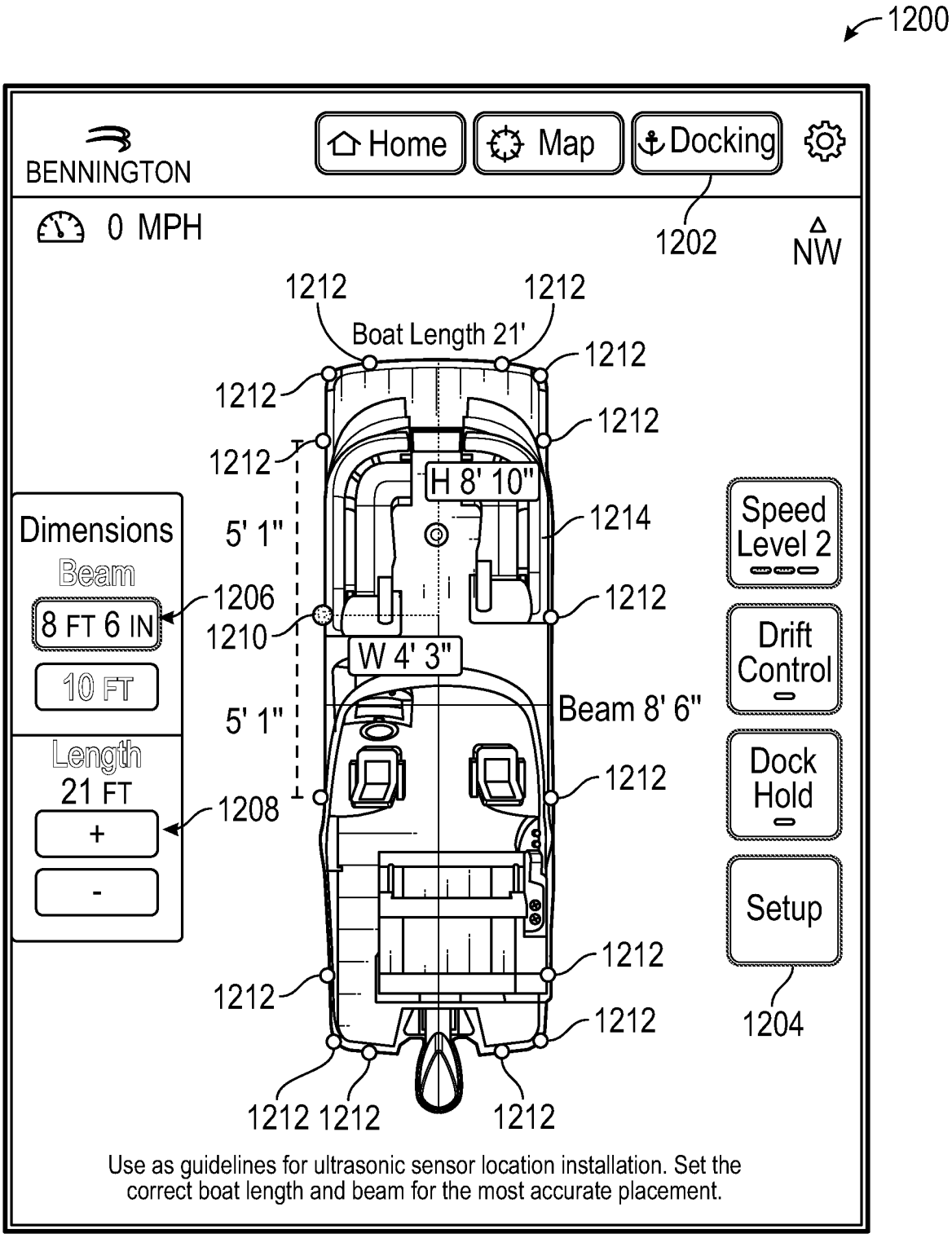
FIGS. 12A-C illustrate example user interface aspects according to aspects described herein.
Figure 12B:
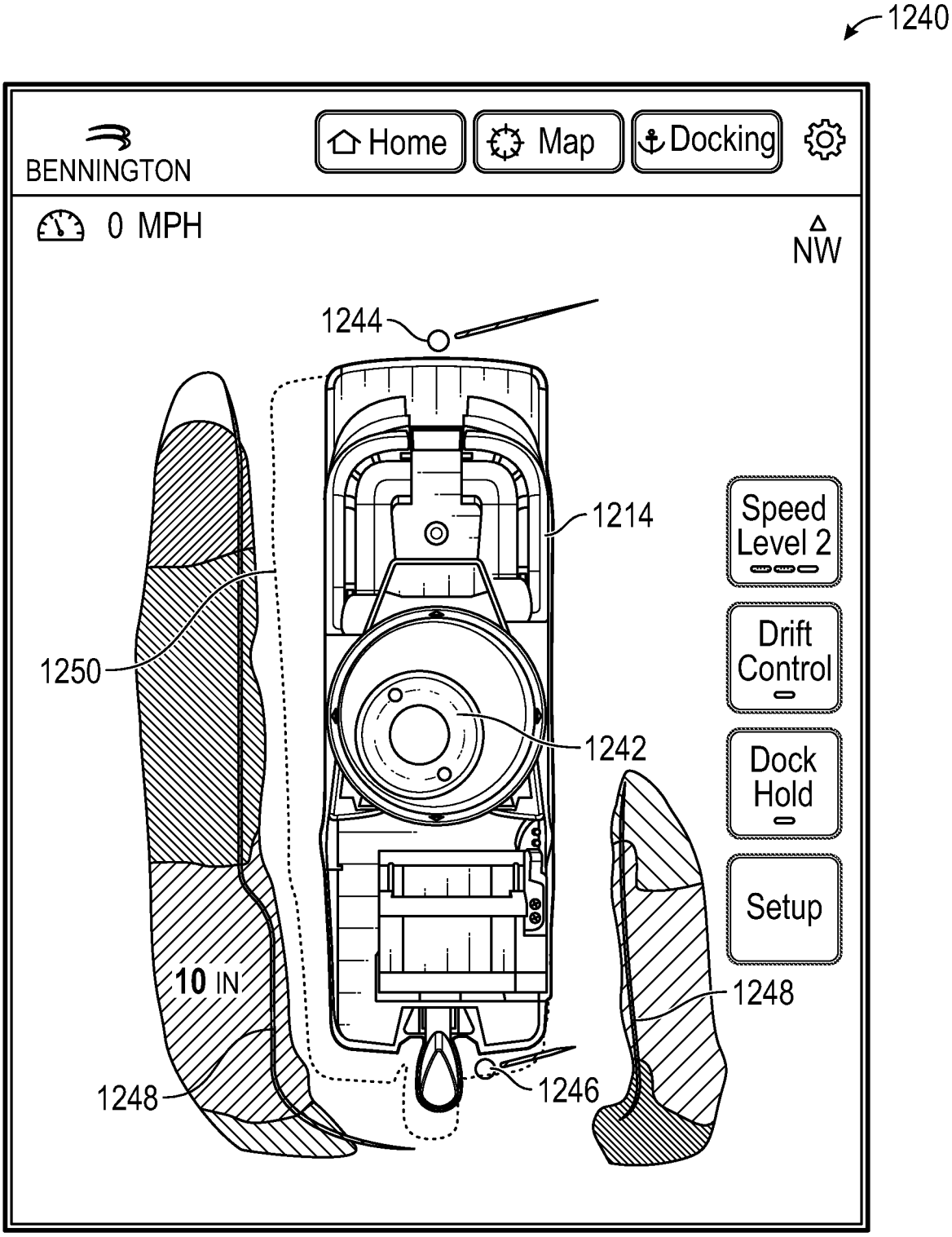
Figure 12C:
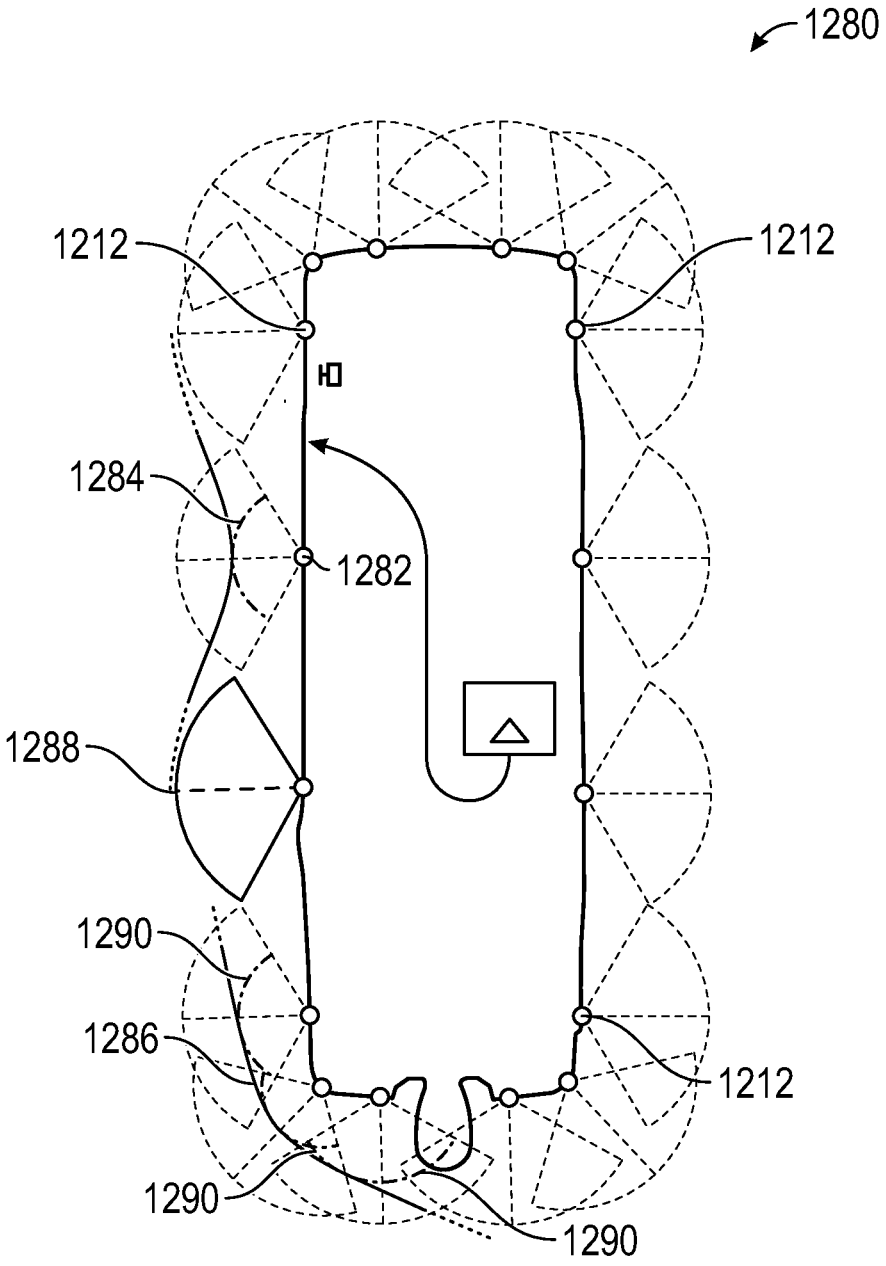

FIGS. 12A-C illustrate example user interface aspects according to aspects described herein. Such user interface aspects may be implemented by an operator application of an operator device, such as operator application 612 of operator device 604 discussed above with respect to FIG. 6. In other examples, such aspects may similarly be presented to an operator of a pontoon boat via a display at an operator console, such as operator console 190 discussed above.

As illustrated in FIG. 12A, user interface 1200 includes a docking tab 1202, in which outline 1214 depicts the outline of an associated pontoon boat (e.g., pontoon boat 100). User interface 1200 is more specifically associated with a setup process, as indicated by actuated setup user interface element 1204. Accordingly, an operator may configure various aspects of the thruster system, for example entering a beam dimension 1206 and a length 1208 associated with the pontoon boat.

User interface 1200 is further illustrated as comprising sensor locations 1210 and 1212. In examples, an operator may configure each sensor location and, as illustrated, sensor location 1210 is currently selected for configuration. Thus, in instances where a thruster system is installed after manufacture, an operator may arrange sensors in a given configuration and may then configure the thruster system using an interface similar to that of user interface 1200. For example, an operator may drag and drop sensor location 1210 along outline 1214 or, as another example, may enter a distance between sensor 1210 and other proximate sensors. Thus, it will be appreciated that any of a variety of configuration techniques and associated user experience paradigms may be used.

Turning now to FIG. 12B, user interface 1240 illustrates an example where the thruster system is in use. As illustrated, user interface 1240 comprises joystick element 1242, thruster elements 1244 and 1246, obstacle indicators 1248, and movement intent line 1250. In examples where a thruster input control is present (e.g., in addition to such user interface aspects), joystick element 1242 may graphically represent input received at the thruster input control (e.g., joystick 402 of thruster input control 196 discussed above with respect to FIGS. 4 and 5). In some examples, joystick element 1242 may be present only when user input is received via the thruster input control. In other examples, joystick element 1242 may be used by an operator to provide user input for controlling the thruster system as described herein.

Thruster elements 1244 and 1246 may be included to provide an indication as to the magnitude and direction of the force being generated by associated thrusters. While user interface 1240 is illustrated as comprising two thruster elements 1244 and 1246, it will be appreciated that additional or fewer such elements may be included, as may be the case when a pontoon boat has additional or fewer thrusters.

Obstacle indicators 1248 display an indication as to detected obstacles (e.g., as may be detected by sensors, such as sensors 212 or sensors 306 discussed above with respect to FIG. 6). In examples, the sensors may have been configured using user interface 1200 discussed above with respect to FIG. 12A. As illustrated, obstacle indicators 1248 may be color-coded according to a detected proximity to the pontoon boat (e.g., as represented by outline 1214). In instances where sensor data is unavailable (e.g., as a result of an obstacle being too far away from the sensor for detection), the obstacle indicator is illustrated as fading away.

It will be appreciated that any of a variety of other graphical techniques may be used to convey detected obstacles, including different color schemes and graphical depictions of identified obstacles (e.g., as may be identified using computer vision techniques). Further, user interface 1240 may be used to convey additional or alternative types of obstacles and information, such as depth information detected from terrain below pontoon boat 100 or map data (e.g., as may be accessed from a local data store or from the Internet). Further, similar techniques may be used to present image data from one or more cameras of the pontoon boat, thereby enabling an operator to view the environment of the pontoon boat while maneuvering the pontoon boat according to aspects described herein.

Movement intent line 1250 is illustrated as a dashed line having a substantially similar shape to that of outline 1214 (and, by extension, pontoon boat 100). In examples, the position of movement intent line 1250 is updated according to user input that is received to control the thruster system. For example, as illustrated, movement intent line 1250 indicates user input is received to move pontoon boat 100 toward the port-stern corner, which is consistent with the user input conveyed by joystick element 1242.

In addition to or as an alternative to user input via a thruster input control, movement intent line 1250 may be manipulated by an operator using a touch screen. For example, the operator may drag movement intent line in a desired direction of travel. As another example, the operator may use two fingers to indicate a desired rotation. In instances where touch input is received, the color of movement intent line 1250 may change or another indication may be provided to indicate that a user is currently controlling the thruster system.

Thus, movement intent line 1250 provides a two-dimensional graphical representation as to the input received from an operator, such that an operator may better understand how provided input will be processed and implemented by the thruster system. In combination with obstacle indicators 1248, movement intent line 1250 and the associated movement possible by the thruster system enable an operator to better maneuver the pontoon boat as compared to more conventional use of an outboard prime mover.

FIG. 12C illustrates an example diagram 1280 illustrating associations between sensor data and resulting obstacle indicators. In the instant examples, sensors 1212 are usable to identify a distance at which an obstacle is detected, within a certain arc 1288. Thus, it may be difficult to detect whether the obstacle is directly in front of a sensor or off-center. Accordingly, in instances where a single sensors identifies an obstacle, an obstacle indicator similar to that of obstacle indicator 1284 may be generated. Obstacle indicator 1284 increases in distance from the graphical representation of the pontoon boat and ultimately disappears (e.g., as a result of no detected obstacle within arc 1288), thereby providing an indication of an obstacle that may be interpreted by an operator as having some degree of uncertainty. By contrast, obstacle indicator 1286 is generated based on sensor data from multiple sensors. As illustrated, obstacle indicator 1286 is generated in such a way that it intersects the detection arcs 1290 of the associated sensors. Thus, the shape of obstacle indicator 1286 may more closely resemble the actual shape of the obstacle as a result of data from additional sensors.

It will be appreciated that the aspects described herein may be used in any of a variety of contexts, for example while docking, navigating around an obstacle, or maneuvering in an area of decreased depth. Such aspects need not be limited to control of a thruster system, and may similarly be used to control an outboard prime mover in addition or as an alternative to a thruster system. As another example, user interface aspects similar to those discussed above with respect to FIGS. 12A-12C may be used in contexts where the pontoon boat operates at least partially under autonomous control. For example, a user interface similar to that of FIG. 12B may enable an operator to define a route to be traveled by the pontoon boat and/or respond to identified obstacles during autonomous operation. Additional contexts in which aspects of the present disclosure may be applied are described by U.S. application Ser. No. 17/032,300, titled "SYSTEM AND METHOD FOR POSITIONING AN AQUATIC VESSEL," the entirety of which is hereby incorporated by reference for all purposes.

While this aspects of the present disclosure has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

The following clauses are provided as example aspects of the disclosed subject matter:

1. A pontoon boat comprising: a plurality of pontoons; a deck supported by the plurality of pontoons, the deck having an outer perimeter; a propulsion system having at least one prime mover that propels the pontoon boat through the water; a thruster system including a first thruster and a second thruster, wherein at least one thruster of the first thruster or the second thruster has a deactivated position and an in-use position; and a controller communicatively coupled to the first thruster and the second thruster, the controller configured to: identify a first condition; based on the first condition, configure the at least one thruster to be in the in-use position; identify a second condition; and based on the second condition, configure the at least one thruster to be in the deactivated position.
2. The pontoon boat of clause 1, further comprising a removable thruster input control removably coupled to an operator console of the deck, wherein the removable thruster input control is communicatively coupled to the controller.
3. The pontoon boat of clause 2, wherein the first condition is identified based on a user indication received via the removable thruster input control to enable the thruster system.
4. The pontoon boat of any one of clauses 2-3, wherein the second condition is identified based on a user indication received via the removable thruster input control to disable the thruster system.
5. The pontoon boat of any one of clauses 1-4, wherein identifying the first condition comprises determining a speed of the pontoon boat is below a predetermined threshold.
6. The pontoon boat of any one of clauses 1-5, wherein identifying the first condition comprises: determining a power source of the thruster system is below a predetermined threshold; and based on determining the power source is below the predetermined threshold, configuring the thruster system to charge the power source using current generated by the thruster system when the at least one prime mover propels the pontoon boat through the water.
7. The pontoon boat of any one of clauses 1-6, further comprising a plurality of sensors supported by the plurality of pontoons and wherein the second condition is identified based on sensor data from at least one of the plurality of sensors.
8. The pontoon boat of clause 7, wherein: the plurality of sensors comprises at least one of a global positioning system or an inertial measurement unit; and the controller is further configured to: determine an actual motion using the plurality of sensors; determine the actual motion differs from a target motion; and based on determining the actual motion differs from the target motion: adapt a target motion based on the actual motion to generate an adapted target motion; and provide, to at least one of the first thruster and the second thruster, a command based on the adapted target motion.
9. The pontoon boat of clause 8, wherein the controller is further configured to: determine the target motion based on user input received from a removable thruster input control.
10. The pontoon boat of any one of clauses 8-9, wherein: the actual motion is at least one of translational motion or rotational motion; and the target motion is at least one of translational motion or rotational motion.
11. The pontoon boat of any one of clauses 1-10, wherein the controller is communicatively coupled to a propulsion controller of the propulsion system via a network connection.
12. The pontoon boat of clause 11, wherein identifying the second condition comprises: obtaining propulsion system information via the network connection to the propulsion controller; and determining the propulsion system information exceeds a predetermined threshold.
13. The pontoon boat of any one of clauses 11-12, wherein identifying the second condition comprises determining a power source of the propulsion system is below a predetermined threshold.
14. The pontoon boat of any one of clauses 1-13, wherein the first thruster is a fixed thruster and the second thruster is a steerable thruster.
15. The pontoon boat of clause 14, wherein: the first thruster is positioned at a forward of the pontoon boat; and the second thruster is positioned at an aft of the pontoon boat.
16. The pontoon boat of clause 15, wherein the first thruster and the second thruster are positioned along a longitudinal centerline of the pontoon boat.
17. The pontoon boat of any one of clauses 1-16, wherein the controller is communicatively coupled to the first thruster and the second thruster using a network bus of the pontoon boat.
18. A thruster system for a pontoon boat, comprising: a first thruster; a second thruster; a plurality of sensors; and a controller configured to: obtain, via a network bus of the pontoon boat, propulsion system information associated with a propulsion system of the pontoon boat; identify, based on the propulsion system information, a condition; and based on the identified condition, configure at least one thruster of the first thruster and the second thruster to be in either an in-use position or a deactivated position.
19. The thruster system of clause 18, wherein identifying the condition comprises: determining the propulsion system information indicates that a speed of the pontoon boat is below a predetermined threshold; and configuring the at least one thruster to be in the in-use position.
20. The thruster system of clause 18, wherein identifying the condition comprises: determining the propulsion system information exceeds a predetermined threshold; and configuring the at least one thruster to be in the deactivated position.
21. The thruster system of any one of clauses 18-20, further comprising a removable thruster input control configured to be removably coupled to the pontoon boat, wherein the removable thruster input control is communicatively coupled to the controller.

22. The thruster system of clause 21, wherein the controller is further configured to: receive user input from the removable thruster input control; determine an actual motion using the plurality of sensors; determine the actual motion differs from a target motion associated with the received user input; and based on determining the actual motion differs from the target motion: adapt a target motion based on the actual motion to generate an adapted target motion; and provide, to at least one of the first thruster and the second thruster, a command based on the adapted target motion.

23. The thruster system of clause 22, wherein: the actual motion is at least one of translational motion or rotational motion; and the target motion is at least one of translational motion or rotational motion.

24. The thruster system of any one of clauses 18-23, wherein the first thruster is a fixed thruster and the second thruster is a steerable thruster.

25. The thruster system of clause 18, wherein the controller is configured to be communicatively coupled to the first thruster and the second thruster using a network bus of the pontoon boat.

26. A method for generating a user interface associated with a thruster system, the method comprising: presenting an outline associated with a pontoon boat; receiving a user input indicating a target movement for the pontoon boat; generating, based on the received user input, a movement intent line in association with the outline, wherein the movement intent line indicates at least one of a target movement direction, a target movement magnitude, or a target movement rotation; and updating the user interface to comprise the generated movement intent line.

27. The method of clause 26, further comprising: obtaining sensor data from a plurality of sensors of the pontoon boat; identifying, using the sensor data, an obstacle; generating an obstacle indication associated with the obstacle; and updating the user interface to comprise the generated obstacle indication.

28. The method of clause 27, wherein: the obstacle is identified based on sensor data from a plurality of sensors; and the generated obstacle indication is displayed in association with a plurality of sensor locations associated with plurality of sensors.

29. The method of any one of clauses 26-28, wherein the user input is received via a touch-sensitive display on which the user interface is presented.

30. The method of any one of clauses 26-29, wherein the user input is received from a removable thruster input control.

31. The method of clause 30, wherein the user interface further comprises a joystick element indicating the received user input.

32. The method of any one of clauses 26-31, wherein the user interface further comprises a plurality of thruster elements, each associated with a thruster of the thruster system.

What is claimed is:

1. A pontoon boat comprising:

a plurality of pontoons;

a deck supported by the plurality of pontoons, the deck having an outer perimeter;

a propulsion system having at least one prime mover that propels the pontoon boat through water;

a thruster system including a first thruster and a second thruster, wherein at least one thruster of the first thruster or the second thruster has a deactivated position and an in-use position;

a plurality of sensors supported by the plurality of pontoons, the plurality of sensors configured to generate one or more signals; and a controller communicatively coupled to the first thruster and the second thruster, the controller configured to:

identify a first condition;

based on the first condition, configure the at least one thruster to be in the in-use position;

detect an environmental condition proximate at least one of the plurality of pontoons based on the one or more signals from the plurality of sensors;

identify a second condition; and based on the second condition, configure the at least one thruster to be in the deactivated position.

2. The pontoon boat of claim 1, further comprising a removable thruster input control removably coupled to an operator console of the deck, wherein the removable thruster input control is communicatively coupled to the controller.

3. The pontoon boat of claim 2, wherein the first condition is identified based on a user indication received via the removable thruster input control to enable the thruster system.

4. The pontoon boat of claim 2, wherein the second condition is identified based on a user indication received via the removable thruster input control to disable the thruster system.

5. The pontoon boat of claim 1, wherein identifying the first condition comprises determining a speed of the pontoon boat is below a predetermined threshold.

6. The pontoon boat of claim 1, wherein identifying the first condition comprises:

determining a power source of the thruster system is below a predetermined threshold; and based on determining the power source is below the predetermined threshold, configuring the thruster system to charge the power source using current generated by the thruster system when the at least one prime mover propels the pontoon boat through the water.

7. The pontoon boat of claim 1, wherein the plurality of sensors are supported by the plurality of pontoons and wherein the second condition is identified based on sensor data from at least one of the plurality of sensors.

8. The pontoon boat of claim 7, wherein:

the plurality of sensors comprises at least one of a global positioning system or an inertial measurement unit; and the controller is further configured to:

determine an actual motion using the plurality of sensors;

determine the actual motion differs from a target motion, and based on determining the actual motion differs from the target motion:

adapt the target motion based on the actual motion to generate an adapted target motion; and provide, to at least one of the first thruster and the second thruster, a command based on the adapted target motion.

9. The pontoon boat of claim 8, wherein the controller is further configured to:

determine the target motion based on user input received from a removable thruster input control.

10. The pontoon boat of claim 8, wherein:

the actual motion is at least one of translational motion or rotational motion; and the target motion is at least one of translational motion or rotational motion.

11. The pontoon boat of claim 1, wherein the controller is communicatively coupled to a propulsion controller of the propulsion system via a network connection.

12. The pontoon boat of claim 11, wherein identifying the second condition comprises:

obtaining propulsion system information via the network connection to the propulsion controller; and determining the propulsion system information exceeds a predetermined threshold.

13. The pontoon boat of claim 11, wherein identifying the second condition comprises determining a power source of the propulsion system is below a predetermined threshold.

14. The pontoon boat of claim 1, wherein the first thruster is a fixed thruster and the second thruster is a steerable thruster.

15. The pontoon boat of claim 14, wherein:

the first thruster is positioned at a forward of the pontoon boat; and the second thruster is positioned at an aft of the pontoon boat.

16. The pontoon boat of claim 15, wherein the first thruster and the second thruster are positioned along a longitudinal centerline of the pontoon boat.

17. The pontoon boat of claim 1, wherein the controller is communicatively coupled to the first thruster and the second thruster using a network bus of the pontoon boat.

* * * * *